US006246178B1

(12) United States Patent
Isono

(10) Patent No.: US 6,246,178 B1
(45) Date of Patent: Jun. 12, 2001

(54) ELECTRON SOURCE AND IMAGE FORMING APPARATUS USING THE ELECTRON SOURCE

(75) Inventor: Aoji Isono, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/389,453

(22) Filed: Sep. 3, 1999

(30) Foreign Application Priority Data

Sep. 4, 1998 (JP) ..... 10-251480
Sep. 4, 1998 (JP) ..... 10-251481
Aug. 31, 1999 (JP) ..... 11-246616

(51) Int. Cl.[7] ..... G09G 3/10

(52) U.S. Cl. ..... 315/169.3; 315/169.1; 313/336; 345/74

(58) Field of Search ..... 315/169.1, 169.3, 315/169.4, 167, 334, 349; 345/73, 74, 75, 76; 313/309, 336, 351, 498, 500, 505

(56) References Cited

U.S. PATENT DOCUMENTS

| | | | | |
|---|---|---|---|---|
| 4,904,895 | | 2/1990 | Tsukamoto et al. | 313/336 |
| 5,066,883 | | 11/1991 | Yoshioka et al. | 313/309 |
| 5,593,335 | * | 1/1997 | Suzuki et al. | 445/50 |
| 5,627,436 | | 5/1997 | Suzuki | 315/169.1 |
| 5,650,795 | * | 7/1997 | Banno et al. | 345/74 |
| 5,998,924 | * | 12/1999 | Yamamoto et al. | 313/496 |
| 6,005,540 | * | 12/1999 | Shinjo et al. | 345/74 |

FOREIGN PATENT DOCUMENTS

| | | |
|---|---|---|
| 64-31332 | 2/1989 | (JP) . |
| 2-257551 | 10/1990 | (JP) . |
| 3-55738 | 3/1991 | (JP) . |
| 4-28137 | 1/1992 | (JP) . |
| 4-104438 | 4/1992 | (JP) . |
| 8-190878 | 7/1996 | (JP) . |
| 8-203420 | 8/1996 | (JP) . |
| 9-134144 | 5/1997 | (JP) . |
| 9-231920 | 9/1997 | (JP) . |
| 11-176363 | 7/1999 | (JP) . |
| 11-224075 | 8/1999 | (JP) . |

OTHER PUBLICATIONS

M.I. Elinson, et al., "The Emission of Hot Electrons and the Field Emission of Electrons from Tin Oxide", Radio Engineering and Electronic Physics, No. 7, pp. 1290–1296 (Jul. 1965).

G. Dittmer, Electrical Conduction and Electron Emission of Discontinuous Thin Films, Thin Solid Films, 9, pp. 317–328 (1972).

M. Hartwell, et al., "Strong Electron Emission from Patterned Tin–Indium Oxide Thin Films", International Electron Devices Meeting, pp. 519–521 (1975).

(List continued on next page.)

*Primary Examiner*—David Vu
*Assistant Examiner*—Ephren Alemu
(74) *Attorney, Agent, or Firm*—Fitzpatrick, Cella, Harper & Scinto

(57) ABSTRACT

An electron source includes a plurality of electron emitting devices arranged in a matrix, and an image forming apparatus uses the electron source. Each of the row-direction wirings of the electron source is selected sequentially and a scan signal is applied thereto, and in synchronization of the scan signal, a modulation signal corresponding to an image signal is applied to the column-direction wiring. The row- and column-direction wirings of the electron source are connected by a connection cable having an impedance substantially equal to a characteristic impedance of a driving area of the electron source, thereby preventing signal ringing in the inputted scan signals and modulation signals. In place of the connection cable, a damping resistance having a resistance value substantially equal to the characteristic impedance may be connected in serial to each of the column- or row-direction wirings, to prevent the signal ringing.

32 Claims, 26 Drawing Sheets

OTHER PUBLICATIONS

H. Araki, et al., "Electroforming and Electron Emission of Carbon Thin Films", Journal of the Vacuum Society of Japan, vol. 26, No. 1, pp. 22–29 (Jan. 26, 1983).

W.P. Dyke, et al., "Field Emission", Advances in Electronics and Electron Physics, vol. VIII, pp. 89–185 (1956).

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

C.A. Mead, "Operation of Tunnel–Emission Devices", Journal of Applied Physics, vol. 32, No. 4, pp. 646–652 (Apr. 1961).

R. Meyer, "Recent Development on "Microtips" Display at LETI", Technical Digest of IVMC 91, pp. 6–9 (1991).

* cited by examiner

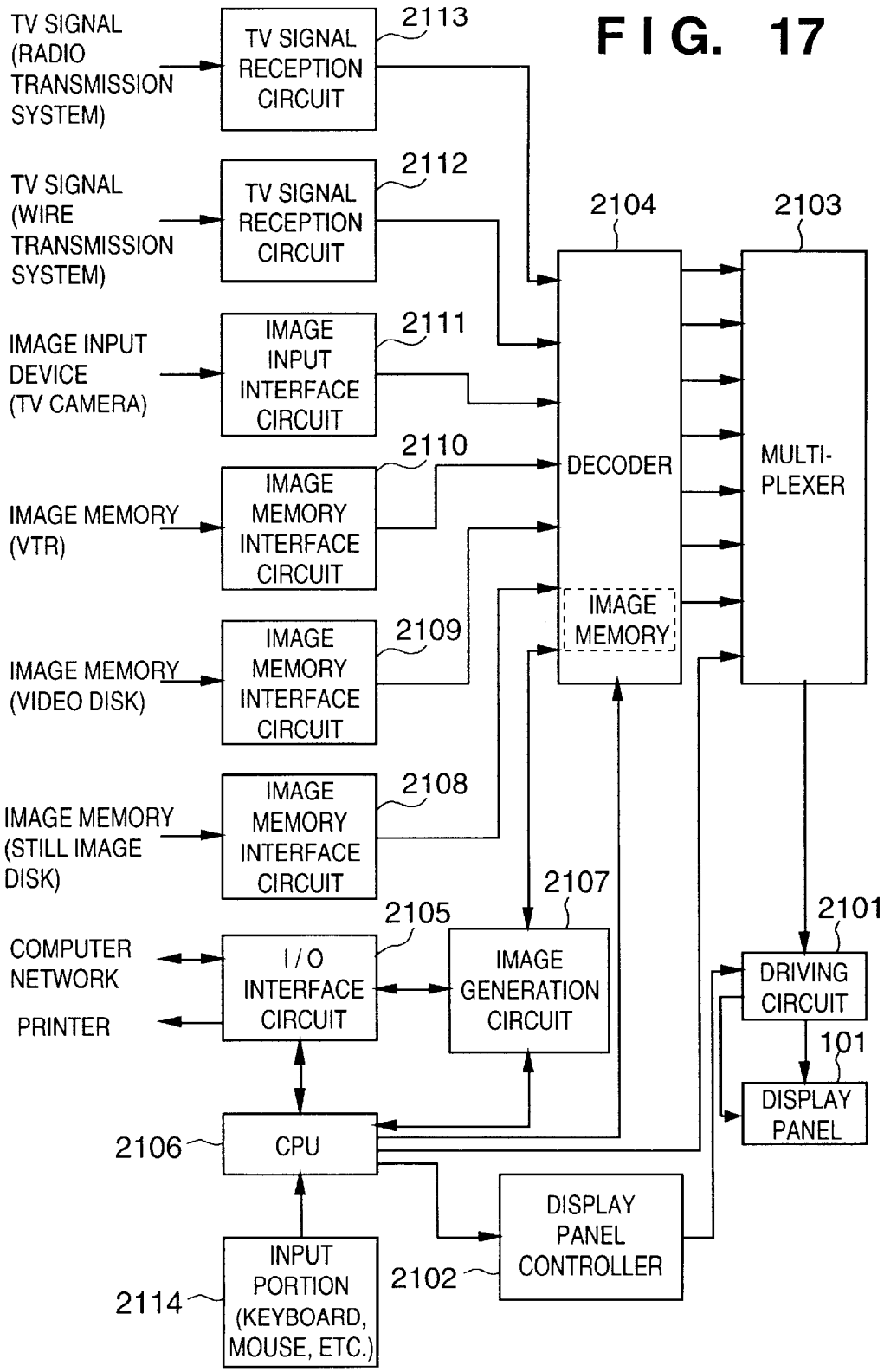
FIG. 17
TV SIGNAL (RADIO TRANSMISSION SYSTEM)
TV SIGNAL RECEPTION CIRCUIT
2113
TV SIGNAL (WIRE TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE MEMORY INTERFACE CIRCUIT
2110
IMAGE MEMORY (VIDEO DISK)
IMAGE MEMORY INTERFACE CIRCUIT
2109
IMAGE MEMORY (STILL IMAGE DISK)
IMAGE MEMORY INTERFACE CIRCUIT
2108
2104
DECODER
IMAGE MEMORY
2103
MULTI-PLEXER
2107
IMAGE GENERATION CIRCUIT
2105
COMPUTER NETWORK
PRINTER
I/O INTERFACE CIRCUIT
2101
DRIVING CIRCUIT
101
DISPLAY PANEL
2106
CPU
DISPLAY PANEL CONTROLLER
2102
2114
INPUT PORTION (KEYBOARD, MOUSE, ETC.)

ELECTRON SOURCE AND IMAGE FORMING APPARATUS USING THE ELECTRON SOURCE

BACKGROUND OF THE INVENTION

The present invention relates to an electron source having a plurality of electron emitting devices, and an image forming apparatus using the electron source for forming images.

Lately, various efforts have been made in research and development of a thin and large screen display apparatus. The inventor of the present invention has been studying the use of cold cathode as an electron source in a thin and large screen display apparatus.

Conventionally, two types of devices, namely thermionic and cold cathode devices, are known as electron emitting devices. Examples of cold cathode devices are surface-conduction-type emitting devices, field-emission-type devices (to be referred to as FE-type devices hereinafter), and metal/insulator/metal type emission devices (to be referred to as MIM-type devices hereinafter).

A known example of the surface-conduction-type emitting devices is described in, e.g., M. I. Elinson, Radio. Eng. Electron Phys., 10, 1290 (1965) and other examples to be described later.

The surface-conduction-type emitting device utilizes a phenomenon in which electron emission is caused in a small-area thin film formed on a substrate, by providing a current parallel to the film surface. The surface-conduction-type emitting device includes devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), and a carbon thin film (Hisashi Araki, et al., "Vacuum", Vol. 26, No. 1, p. 22 (1983)), and the like, in addition to an $SnO_2$ thin film according to Elinson mentioned above.

FIG. 22 is a plan view of the surface-conduction-type emitting device according to M. Hartwell et al. as a typical example of the structures of these surface-conduction-type emitting devices. Referring to FIG. 22, reference numeral 3001 denotes a substrate; and 3004, a conductive thin film made of metal oxide formed by sputtering. This conductive thin film 3004 has an H-shaped plane pattern, as shown in FIG. 22. An electron emitting portion 3005 is formed by performing an electrification process (referred to as an energization forming process to be described later) with respect to the conductive thin film 3004. Referring to FIG. 22, the spacing L is set to 0.5 to 1 mm, and the width W is set to 0.1 mm. The electron emitting portion 3005 is shown in a rectangular shape at the center of the conductive thin film 3004 for the sake of illustrative convenience, however, this does not exactly show the actual position and shape of the electron emitting portion.

In the above surface-conduction-type emitting device by M. Hartwell et al., typically the electron emitting portion 3005 is formed by performing the electrification process called energization forming process for the conductive thin film 3004 before electron emission. According to the energization forming process, electrification is performed by applying a constant or varying DC voltage which increases at a very slow rate of, e.g., 1 V/min, to both ends of the conductive thin film 3004, so as to partially destroy or deform the conductive thin film 3004 or change the properties of the conductive thin film 3004, thereby forming the electron emitting portion 3005 with an electrically high resistance. Note that the destroyed or deformed part of the conductive thin film 3004 or part where the properties are changed has a fissure. Upon application of an appropriate voltage to the conductive thin film 3004 after the energization forming process, electron emission occurs near the fissure.

Known examples of the FE-type devices are described in W. P. Dyke and W. W. Dolan, "Field Emission", Advance in Electron Physics, 8,89 (1956) and C. A. Spindt, "Physical properties of thin-film field emission cathodes with molybdenum cones", J. Appl. Phys., 47,5248 (1976).

FIG. 23 is a cross-sectional view of the device according to C. A. Spindt et al. as a typical example of the construction of the FE-type devices. Referring to FIG. 23, reference numeral 3010 denotes a substrate; 3011, an emitter wiring comprising an electrically conductive material; 3012, an emitter cone; 3013, an insulating layer; and 3014, a gate electrode. The device is caused to produce field emission from the tip of the emitter cone 3012 by applying an appropriate voltage across the emitter cone 3012 and gate electrode 3014.

In another example of the construction of an FE-type device, the stacked structure of the kind shown in FIG. 23 is not used. Rather, the emitter and gate electrode are arranged on the substrate in a state substantially parallel to the plane of the substrate.

A known example of the MIM-type is described by C. A. Mead, "Operation of tunnel-emission devices", J. Appl. Phys., 32, 646 (1961). FIG. 24 is a sectional view illustrating a typical example of the construction of the MIM-type device. Referring to FIG. 24, reference numeral 3020 denotes a substrate; 3021, a lower electrode consisting of metal; 3022, a thin insulating layer having a thickness on the order of 100 Ω; and 3023, an upper electrode consisting of metal and having a thickness on the order of 80 to 300 Ω. The device is caused to produce field emission from the surface of the upper electrode 3023 by applying an appropriate voltage across the upper electrode 3023 and lower electrode 3021.

Since the above-mentioned cold cathode device makes it possible to obtain electron emission at a lower temperature in comparison with a thermionic cathode device, a heater for applying heat is unnecessary. Accordingly, the structure is simpler than that of the thermionic cathode device and it is possible to fabricate devices that are finer. Further, even though a large number of devices are arranged on a substrate at a high density, problems such as fusing of the substrate do not easily occur. In addition, the cold cathode device differs from the thermionic cathode device in that the latter has a slow response because it is operated by heat produced by a heater. Thus, an advantage of the cold cathode device is the quicker response.

For these reasons, extensive research into applications for cold cathode devices is being carried out.

By way of example, among the various cold cathode devices, the surface-conduction-type emitting device is particularly simple in structure and easy to manufacture and therefore is advantageous in that a large number of devices can be formed over a large area. Accordingly, research has been directed to a method of arraying and driving a large number of the devices, as disclosed in Japanese Patent Application Laid-Open No. 64-31332, filed by the present applicant.

Further, applications of surface-conduction-type emitting devices that have been researched are image forming apparatuses such as an image display apparatus and an image recording apparatus, charged beam sources, and the like.

As for applications to image display apparatus, research has been conducted with regard to such an image display apparatus using, in combination, surface-conduction-type emitting devices and phosphors which emit light by colliding with electrons, as disclosed, for example, in the specifications of U.S. Pat. No. 5,066,883 and Japanese Patent Application Laid-Open (KOKAI) Nos. 2-257551 and 4-28137 filed by the present applicant. The image display apparatus using the combination of the surface-conduction-type emitting devices and phosphors is expected to have characteristics superior to those of the conventional image display apparatus of other types. For example, in comparison with a liquid-crystal display apparatus that has become so popular in recent years, the above-mentioned image display apparatus is superior since it emits its own light and therefore does not require back-lighting. It also has a wider viewing angle.

A method of driving a number of FE-type devices in a row is disclosed, for example, in the specification of U.S. Pat. No. 4,904,895 filed by the present applicant. A flat-type display apparatus reported by R. Meyer et al., for example, is known as an example of an application of an FE-type device to an image display apparatus. [R. Meyer: "Recent Development on Microtips Display at LETI", Tech. Digest of 4th Int. Vacuum Microelectronics Conf., Nagahama, pp. 6~9, (1991).]

An example in which a number of MIM-type devices are arrayed in a row and applied to an image display apparatus is disclosed in the specification of Japanese Patent Application Laid-Open No. 3-55738 filed by the present applicant.

The present inventor has examined surface-conduction-type emitting devices according to various materials, manufacturing methods, and structures, in addition to the above conventional devices. The present inventor has also studied a multi-electron source in which a large number of surface-conduction-type emitting devices are arranged, and an image display apparatus to which this multi-electron source is applied.

The present inventor has also examined a multi-electron source according to an electric wiring method shown in FIG. 25. More specifically, this multi-electron source is constituted by two-dimensionally arranging a large number of surface-conduction-type emitting devices and wiring these devices in a matrix, as shown in FIG. 25.

Referring to FIG. 25, reference numeral 4001 denotes an electron emitting device; 4002, a row-direction wiring; and 4003, a column-direction wiring. In reality, the row-direction wiring 4002 and the column-direction wiring 4003 include limited electrical resistance; yet, in FIG. 25, they are represented as wiring resistances 4004 and 4005. The wiring shown in FIG. 25 is referred to as simple matrix wiring.

In the multi-electron source in which the surface-conduction-type emitting devices are wired in a simple matrix, appropriate electrical signals are supplied to the row-direction wiring 4002 and the column-direction wiring 4003 to output desired electron beams. For instance, when the surface-conduction-type emitting devices of one arbitrary row in the matrix are to be driven, a selection voltage Vs is applied to the row-direction wiring 4002 of the selected row. Simultaneously, a non-selection voltage Vns is applied to the row-direction wiring 4002 of unselected rows. In synchronization with this operation, a driving voltage Ve for emitting electrons is applied to the column-direction wiring 4003. According to this method, a voltage (Ve−Vs) is applied to the surface-conduction-type emitting devices of the selected row, and a voltage (Ve−Vns) is applied to the surface-conduction-type emitting devices of the unselected rows, assuming that a voltage drop caused by the wiring resistances 4004 and 4005 is negligible. When the voltages Ve, Vs, and Vns are set to appropriate levels, electron beams with a desired intensity are outputted from only the selected row of the surface-conduction-type emitting devices. When different levels of driving voltages Ve are applied to the respective column-direction wiring 4003, electron beams with different intensities are output from the respective devices of the selected row. Since the response rate of the surface-conduction-type emitting device is fast, the period of time over which electron beams are output can also be changed in accordance with the period of time for applying the driving voltage Ve.

Hereinafter, the voltage (Ve−Vs), applied to the device when a row is selected, will be referred to as a device voltage Vf.

As another method of obtaining an electron beam from the multi-electron source in which a plurality of surface-conduction-type emitting devices are wired in a simple matrix, instead of connecting a voltage source for applying a driving voltage Ve with the column-direction wiring, a current source for supplying a driving current may be connected so as to apply a selection voltage Vs to a selected row-direction wiring and apply a non-selection voltage Vns to unselected row-direction wirings. According to this method, because the device has a remarkable threshold characteristic, an electron beam can be outputted only from devices of the selected row. Hereinafter, a current flowing in the electron source will be referred to as a device current If, and a current generated by an emitted electron will be referred to as an emission current Ie.

As described above, the multi-electron source, in which surface-conduction-type emitting devices are wired in a simple matrix, has various application possibilities. For instance, by appropriately applying an electric signal corresponding to image data, the multi-electron source can be used as an electron source of an image display apparatus.

However, in reality, the following problems arise in an image display apparatus employing a multi-electron source in which surface-conduction-type emitting devices are wired in a simple matrix.

More specifically, an image display apparatus constructed, as shown in FIG. 26A, with a multi-electron source panel 2300 in which surface-conduction-type emitting devices are wired in a simple matrix, an X driver 2301 which generates a modulation signal for driving the electron source panel 2300, a Y driver 2302 which generates a scan signal, and a flexible substrate 2304 which connects the electron source panel 2300 with each of the drivers 2301 and 2302, has a transmission line illustrated by the equivalent circuit in FIG. 26B when seen from the modulation signal side (the side of the X driver 2301). More specifically, in FIG. 26B, reference numeral 2310 denotes an equivalent circuit of the flexible substrate 2304; 2311, an equivalent circuit of a connection wiring portion provided between the flexible substrate 2304 and the image display area of the electron source panel 2300 where an image is actually displayed; and 2312, an equivalent circuit of the image display area.

In the foregoing configuration, in a case where each characteristic impedance is different among the image display area of the electron source panel 2300, connection wiring area of the electron source panel 2300, and flexible substrate 2304, reflection or the like occurs due to the unmatched impedance among these areas, and ringing is generated in the modulation signal applied to the column-direction wirings. Due to the ringing, the driving voltage of each device varies, and as a result, luminance fluctuates, making it impossible to attain a display image of desired quality.

SUMMARY OF THE INVENTION

The present invention is made in consideration of the above situation, and has as its object to provide an electron source which can drive electron emitting devices while suppressing ringing in a driving signal supplied to the electron source, and to provide an image forming apparatus employing the electron source.

Another object of the present invention is to provide an electron source capable of driving electron emitting devices of the electron source through an impedance matched with a characteristic impedance of an electron source driving area, and to provide an image forming apparatus employing the electron source.

Another object of the present invention is to provide an electron source capable of driving electron emitting devices of the electron source through a damping resistance having an impedance matched with a characteristic impedance of an electron source driving area, and to provide an image forming apparatus employing the electron source.

In order to attain the above objects, the electron source according to the present invention has the following configuration.

More specifically, the present invention provides an electron source where a plurality of electron emitting devices are arranged, comprising: driving means for outputting a driving signal to select and drive an electron emitting device of the electron source; and supply means, having an impedance substantially equal to a characteristic impedance of a driving area of the electron source, for supplying the electron source with the driving signal outputted by the driving means.

Furthermore, the supply means may have a damping resistance, having a resistance value substantially equal to the characteristic impedance, and being connected in serial with each signal line that supplies the driving signal.

Furthermore, the supply means may include a connection cable having an impedance substantially equal to the characteristic impedance.

Furthermore, the supply means may have a construction in which column-direction wirings and row-direction wirings intersect through an insulating layer, similar to the driving area of the electron source.

Furthermore, the supply means may be formed with the same conductor and the same insulating layer as the row-direction and column-direction wirings in the driving area of the electron source.

Furthermore, the supply means may include a wiring having a same construction as that of the driving area of the electron source, and a connection cable having an impedance substantially equal to the characteristic impedance.

Furthermore, the electron source comprises a plurality of electron emitting devices arranged in a matrix with row-direction wirings and column-direction wirings. As a driving signal, a modulation signal corresponding to an image signal is inputted to the column-direction wirings.

Furthermore, it is preferable that the characteristic impedance of the supply means be set in a range from approximately a half to twice the value of the characteristic impedance of the driving area of the electron source.

Furthermore, it is preferable that the electron emitting device be a surface-conduction-type emitting device.

Moreover, the present invention provides an image forming apparatus comprising: an electron source in which a plurality of electron emitting devices are arranged in a matrix; scan driving means for selecting and driving an electron emitting device in a row direction of the electron source in synchronization with an image signal; driving means for applying a driving signal according to the image signal to the electron emitting device through a column-direction wiring, in synchronization with driving of the scan driving means; and supply means, having an impedance substantially equal to a characteristic impedance of a driving area of the electron source, for supplying the column-direction wiring with the driving signal outputted by the driving means.

Furthermore, the supply means may have a damping resistance, having a resistance value substantially equal to the characteristic impedance, and being connected in serial with each column-direction wiring that supplies the driving signal.

Furthermore, the supply means may include a connection cable, having an impedance substantially equal to the characteristic impedance.

Furthermore, the supply means may have a construction in which column-direction wirings and row-direction wirings intersect through an insulating layer, similar to the driving area of the electron source.

Furthermore, the supply means may be formed with the same conductor and the same insulating layer as the row-direction and column-direction wirings in the driving area of the electron source.

Furthermore, the supply means may include a wiring having a same construction as that of the driving area of the electron source, and a connection cable having an impedance substantially equal to the characteristic impedance.

Furthermore, the electron source comprises a plurality of electron emitting devices arranged in a matrix with row-direction wirings and column-direction wirings. As a driving signal, a modulation signal corresponding to an image signal is inputted to the column-direction wirings.

Furthermore, it is preferable that the characteristic impedance of the supply means be set in a range from approximately a half to twice the value of the characteristic impedance of the driving area of the electron source.

Furthermore, it is preferable that the electron emitting device be a surface-conduction-type emitting device.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 17 is a block diagram showing a multi-functional image display apparatus employing the image display apparatus according to the present embodiment;

DETAILED DESCRIPTION OF THE PREFERRED EMBODIMENTS

Preferred embodiments of the present invention will be described in detail in accordance with the accompanying drawings.

[First Embodiment]

Figure 1:
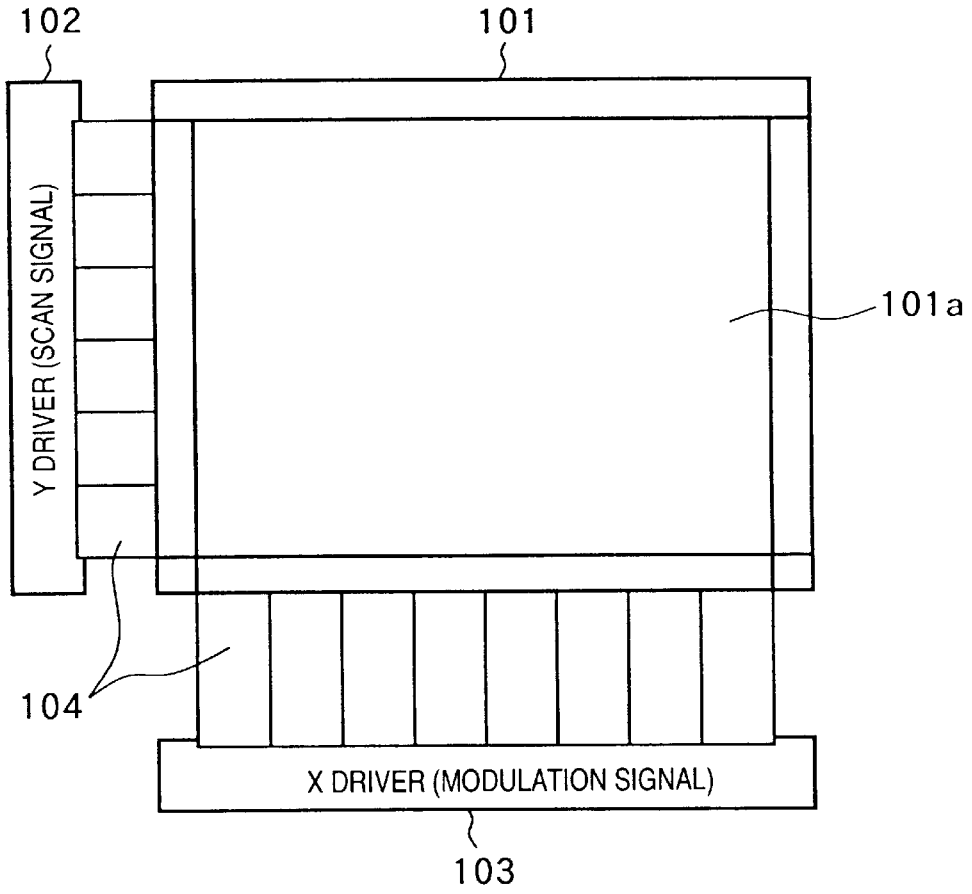
FIG. 1 is an explanatory view showing connections between a display panel and drivers according to a first embodiment of the present invention.
Figure 2:
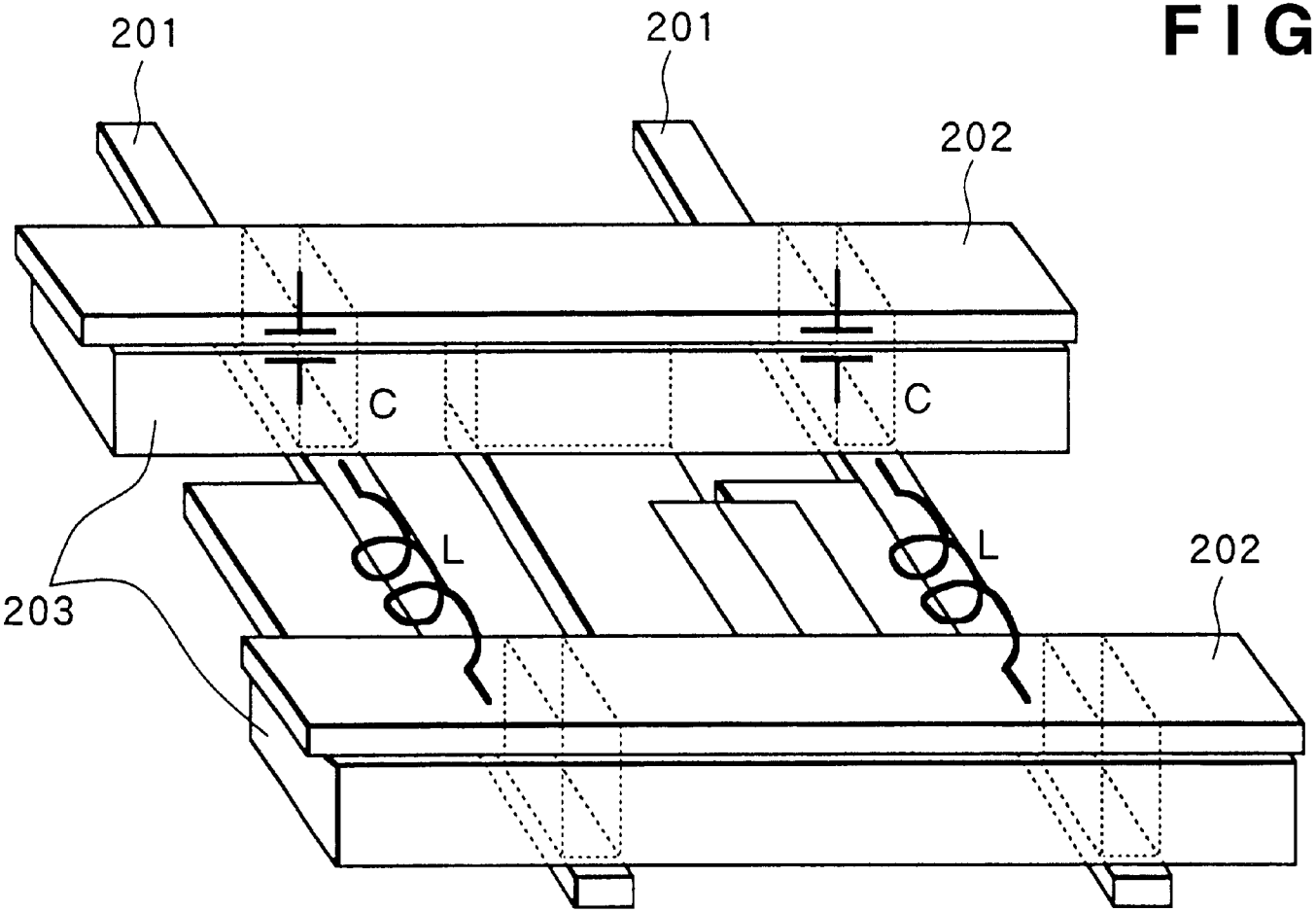
FIG. 2 is an explanatory view showing a wiring structure in the periphery of one surface-conduction-type emitting device in an image display area of the display panel according to the present embodiment.

FIGS. 1 to 3 are views for explaining the connections between a display panel and peripheral drivers according to the first embodiment.

Figure 14:
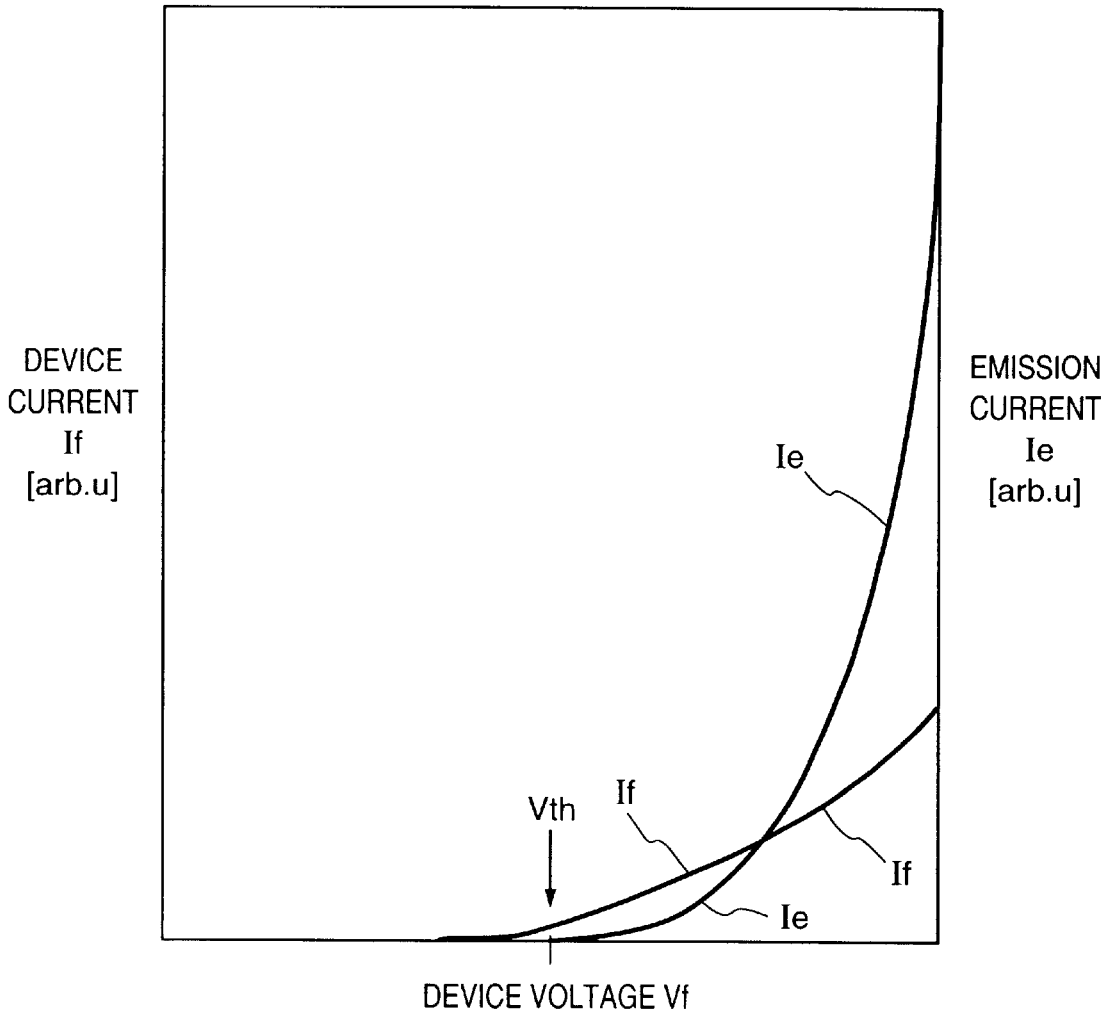
FIG. 14 is a graph showing a typical characteristic of the surface-conduction-type emitting device employed in the present embodiment.

FIG. 1 shows a part of an image display apparatus where a display panel 101 and X and Y drivers 102 and 103 are connected through a flexible substrate 104. The image display apparatus in FIG. 1 comprises: the display panel 101 in which a plurality of surface-conduction-type emitting devices having the (device voltage) to (emission current) characteristic which will be described later with reference to FIG. 14 are arranged in m×n matrix wirings; a Y driver 102 for sequentially scanning row-direction wirings 202 (scan signal wirings) to drive the display panel 101; and an X driver 103 which applies the display panel 101, a modulation signal for displaying an image according to an input signal. Note that reference numeral 101*a* denotes an image display area of the display panel 101.

FIG. 2 is an explanatory view showing a wiring structure in the periphery of one surface-conduction-type emitting device in the image display area 101*a* of the display panel 101.

In the display panel 101, the characteristic impedance of column-direction wirings 201 (modulation signal wirings) driven by the X driver 103 is determined mainly by a reactance of the column-direction wirings 201 in the image display area 101*a*, as well as a capacitance generated in an insulating layer 203 at the intersections of the column-direction wirings 201 and row-direction wirings 202 (scan signal wirings). Assuming that the reactance per device of the image display area 101*a* is L, and a capacitance at an intersection of a column-direction wiring 201 and a row-direction wiring 202 is C, the characteristic impedance Z0 in the direction of the column wiring 201 (modulation signal direction) is expressed approximately by $Z0 \approx \sqrt{L/C}$.

Figure 3A:
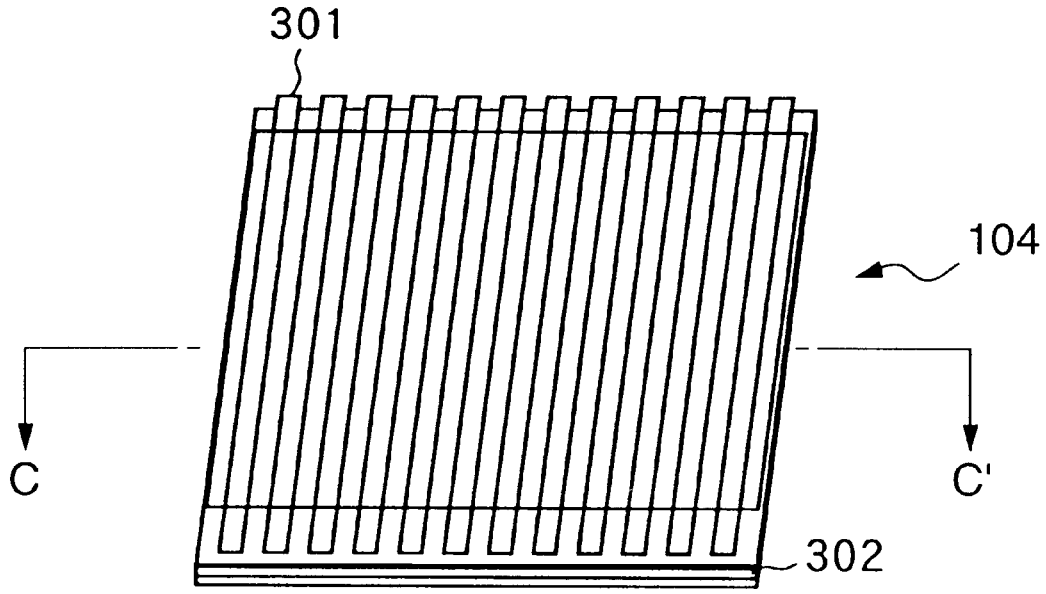
FIGS. 3A and 3B are explanatory views showing a construction of a flexible substrate according to the first embodiment of the present invention.
Figure 3B:
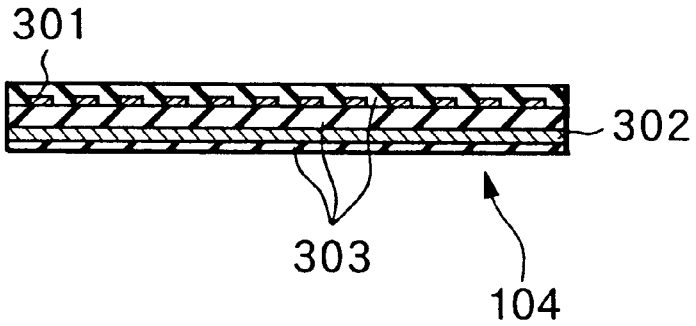

FIGS. 3A and 3B are explanatory views showing a construction of the flexible substrate 104 according to the first embodiment of the present invention, wherein FIG. 3A is a top view of the substrate 104 and FIG. 3B is a cross-section of FIG. 3A cut along the line C–C' of FIG. 3A.

The flexible substrate 104 comprises ordinary copper wirings 301 which allow signals to flow, and an insulating material 303 formed with resin such as polyimide lined with copper foil 302. The characteristic impedance Z0 of the flexible substrate 104 is set substantially the same as the characteristic impedance Z0 $\{\approx\sqrt{L/C}\}$ of the column-direction wirings 201 (modulation signal direction).

As described above, by matching the characteristic impedance of the flexible substrate 104 with the characteristic impedance of the column-direction wirings 201, i.e., impedance in the modulation signal direction, one of ringing factors can be eliminated.

Next, a specific example of a matrix-type display panel having 240×720 pixels is described.

To measure a characteristic impedance of the image display area 101*a* of the display panel 101 in which 240×720 surface-conduction-type emitting devices are arranged, a Test Elements Group (TEG) is first generated. To generate the TEG, a single column-direction wiring, having the width of 90 μm, thickness of 5 μm, and length of 170 mm as similar to the column-direction wiring 201 of the image display area 101*a*, is formed with a silver (Ag) wiring similar to the display panel 101. Probes are placed at both ends of the TEG, and a reactance of the column-direction wiring 201 of the image display area 101*a* is measured by an impedance analyzer (4194A IMPEDANCE/GAIN-PHASE ANALYZER manufactured by YHP). As a result, the reactance was about 170 [nH].

Next, a TEG is generated by 720 column-direction wirings, formed with Ag wirings similar to the display panel 101, with the width of 90 μm, thickness of 5 μm, length of 170 mm, and pitch of 290 μm as similar to the column-direction wirings 201 of the image display area 101*a* of the display panel 101 in which 240×720 surface-conduction-type emitting devices are arranged. Then, on top of the column-direction wirings, at the position corresponding to the row-direction wirings 202 of the display panel 101, 240 insulating layers which are the same as the insulating layer 203 having the width of 460 μm, thickness of 30 μm, length of 220 mm, and relative permittivity of 12, are formed. Then, on the insulating layers, 240 row-direction wirings are formed with Ag wirings similar to the display panel 101, with the width of 300 μm, thickness of 20 μm, length of 220 mm, pitch of 650 μm, as similar to the row-direction wirings 202. Capacitance for the portion where 720 column-direction wirings of the TEG are commonly connected, and the portion where 240 row-direction wirings of the TEG are commonly connected are measured by the aforementioned impedance analyzer (4194A IMPEDANCE/GAIN-PHASE ANALYZER manufactured by YHP). As a result, the capacitance was about 35 [nF]. Since the value 35 [nF] represents capacitance at all the intersections of the 720 column-direction wirings and 240 row-direction wirings, a capacitance at one intersection of the column-direction wiring and row-direction wiring is 35 nF/(720×240)≈0.2 pF.

Herein, although the reactance and capacitance are measured by using the TEG where 240×720 surface-conduction-type emitting devices are arranged in a matrix as similar to the display panel 101, the matrix size is not limited to this. For instance, 10×10 devices arranged in a matrix may be utilized. Furthermore, it is also possible to obtain the reactance and capacitance by calculation based on the shape of the column- and row-direction wirings, resistivity of a wiring, shape of the insulating layer, relative permittivity of the insulating layer or the like.

Based on the foregoing measurement using TEG, the reactance of the column-direction wirings 201 (modulation signal wirings) in the image display area 101*a* in which surface-conduction-type emitting devices are arranged is approximately 170 [nH], and the capacitance at an intersection of a column-direction wiring 202 and a column-direction wiring 201 is approximately 0.2 [pF].

Accordingly, a reactance per device of the image display area 101*a* is about L=170H/240=0.71 [nH], and a capacitance per device is C=0.2 [pF]. Based on these values, a characteristic impedance of the image display area 101*a* of the display panel 101 is roughly calculated to be $Z0 \approx \sqrt{L/C} \approx 60[\Omega]$. Therefore, an impedance matching can be realized by using a substrate having a characteristic impedance of about 60 Ω as the flexible substrate 104 for connecting the column-direction wiring 201 with the X driver 103, or by using as the connection cable 104 the cable which has realized impedance matching by lining the flexible substrate, made of wirings only, with a copper foil tape.

Note that it is most ideal to employ a connection cable which matches the characteristic impedance to 60 Ω set herein. However, an experiment conducted on an image display area where surface-conduction-type emitting devices are arranged teaches that changing the characteristic impedance value in the range from a half to twice the set value does not largely influence the display performance of the display panel 101. Therefore, the characteristic impedance may be set in the range from 30 Ω to 120 Ω.

Furthermore, if the width of the column-direction wiring is changed large to 50 μm, the width of the row-direction wirings 202 is changed to 50 μm, thickness of the insulating layer 203 is changed to 100 μm, and the relative permittivity of the insulating layer 203 is changed to 3 without changing the above-described device pitch, the characteristic impedance becomes Z0≈1 kΩ. Thus, 1 kΩ or less is set as a characteristic impedance design value.

[Second Embodiment]

Figure 4:
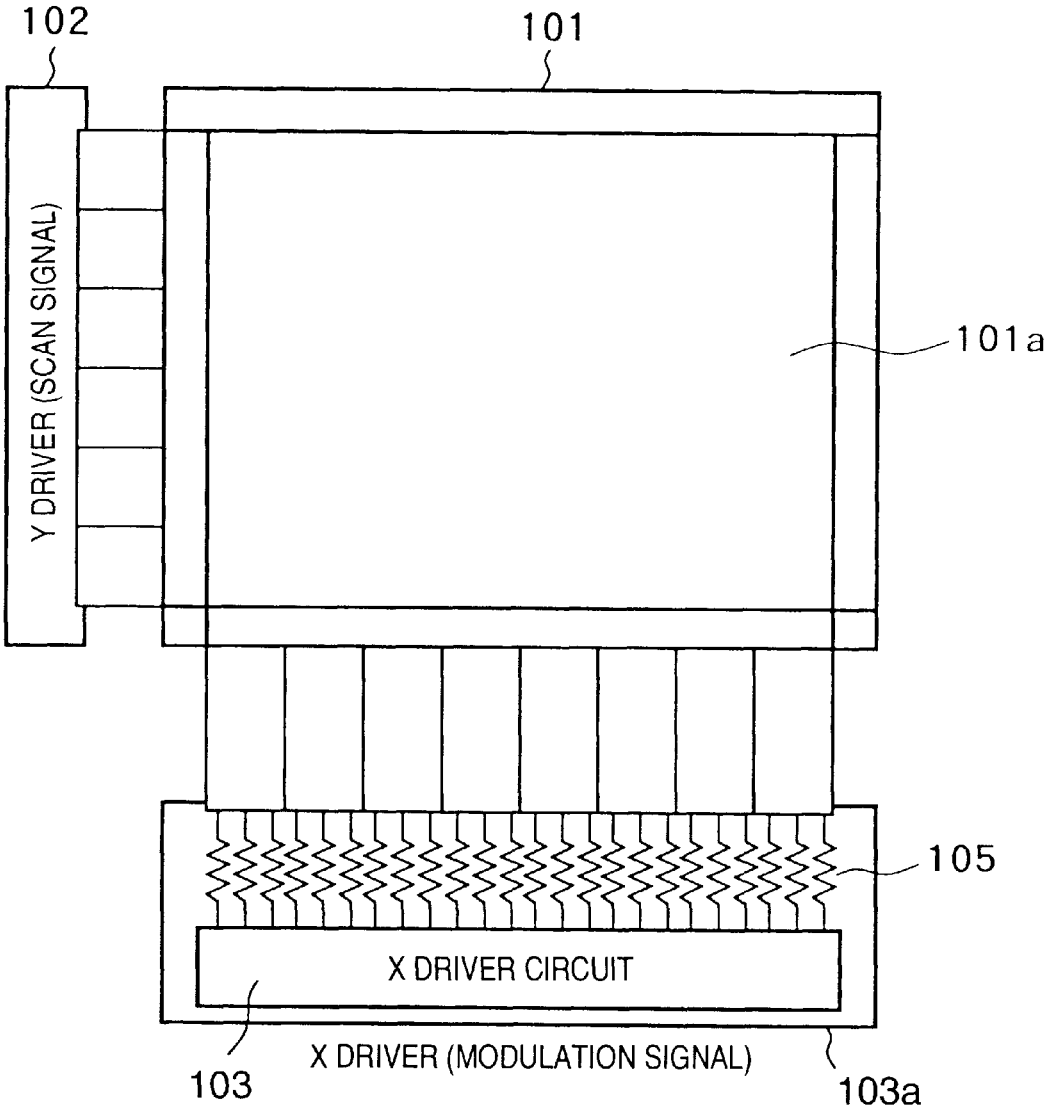
FIG. 4 is an explanatory view showing connections between a display panel and drivers according to a second embodiment of the present invention.
Figure 5:
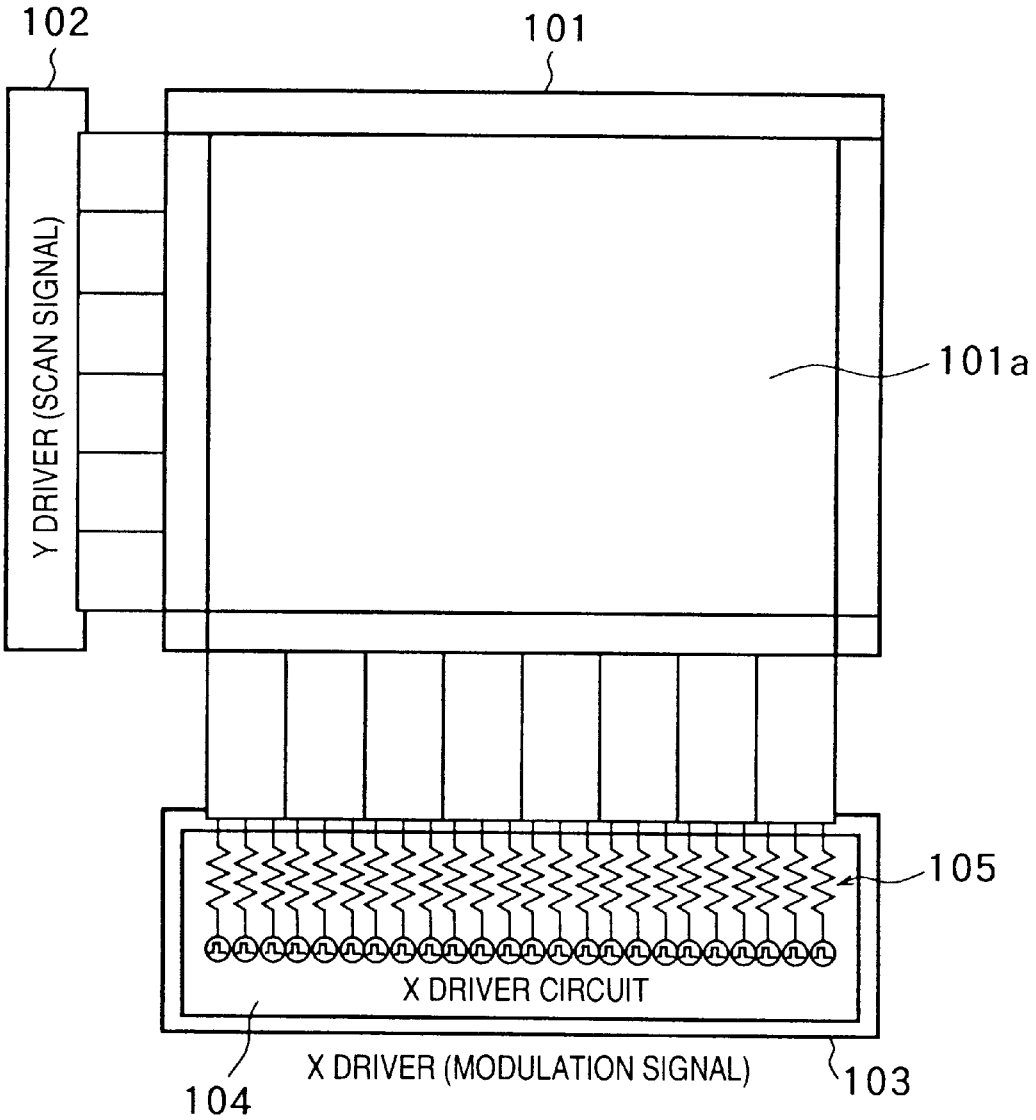
FIG. 5 is an explanatory view showing connections between a display panel and drivers according to the second embodiment.

FIGS. 4 and 5 are explanatory views showing the connections between a display panel 101 according to the second embodiment and the peripheral drivers.

FIG. 4 shows a part of an image display apparatus comprising: a display panel 101 in which a plurality of surface-conduction-type emitting devices having the (device voltage) to (emission current) characteristic which will be described later with reference to FIG. 14 are arranged in m×n matrix wirings; a Y driver 102 for sequentially scanning row-direction wirings (scan signal wirings) to drive the display panel 101; and an X driver 103*a* which applies the display panel 101, a modulation signal for displaying an image according to an input signal. Note that reference numeral 101*a* denotes an image display area of the display panel 101.

The X driver 103*a* comprises an X driver circuit 103, and a damping resistance 105 provided between the X driver circuit 103 and connection wirings of the display panel 101. The resistance value of the damping resistance 105 is set substantially the same as the characteristic impedance of the column-direction wirings of the display panel 101, seen from the X driver 103.

The wiring structure in the periphery of a surface-conduction-type emitting device in the image display area 101*a* of the display panel 101 has already been described with reference to FIG. 2. The characteristic impedance Z0 in the column-direction wirings 201 (modulation signal direction) is expressed approximately by $Z0 \approx \sqrt{L/C}$.

Then, as shown in FIG. 4, the damping resistance 105 having a resistance substantially the same as the characteristic impedance $Z0 \approx \sqrt{L/C}$ of the modulation signal direction is provided between the X driver circuit 103 and the connection wirings in the X driver 103*a*.

By virtue of setting the resistance value of the damping resistance 105 substantially the same as the characteristic impedance Z0 of the modulation signal direction, ringing in a modulation signal can be sufficiently suppressed, and a voltage loss due to voltage drop caused by the damping resistance 105 can be reduced effectively.

The damping resistance 105 may also serve as an X driver 103 output protection resistance (see FIG. 5) for reducing an influence of an external disturbance upon the X driver circuit 103. This is particularly advantageous when these circuits are provided as an integrated circuit (IC).

Hereinafter, a specific example of a matrix-type display panel 101 having 240×720 pixels is described.

Assume that the column-direction wirings 201 in the image display area 101*a* of the display panel 101 are formed with Ag wirings with the width of 90 μm, thickness of 5 μm, length of 170 mm, and pitch of 290 μm, then on top of the column-direction wirings, at the position corresponding to the row-direction wirings 202, an insulating layer 203 is formed with the width of 460 μm. thickness of 30 μm, length of 220 mm, and a relative permittivity of 12, and further on top of the insulating layer 203, row-direction wirings 202 are formed with Ag wirings with the width of 300 $\mu$m, thickness of 20 $\mu$m, length of 220 mm, and pitch of 650 $\mu$m. In this case, the reactance of the column-direction wirings 201 (modulation signal wirings) is about 170 nH, and the capacitance at an intersection of a row-direction wiring 202 and a column-direction wiring 201 is about 0.2 pF. Therefore, the reactance per device of the image display area 101*a* is L=0.71 nH, and the capacitance per device is C=0.2 pF. From these values, the characteristic impedance in the image display area 101*a* of the display panel 101 is roughly calculated to be $Z0 \approx \sqrt{L/C} \approx 60\ \Omega$. Accordingly, a damping resistance having about 60 Ω is selected.

Note that it is most ideal to employ a connection cable which matches the characteristic impedance to 60 Ω set herein. However, an experiment conducted on an image display area where surface-conduction-type emitting devices are arranged teaches that changing the characteristic impedance value in the range from a half to twice the set value does not largely influence the display performance of the display panel 101. Therefore, the damping resistance may be set in the range from 30 Ω to 120 Ω.

Arrangement and Manufacturing Method of Display Panel

Next, the arrangement and manufacturing method of a display panel 101 of the image display apparatus according to the embodiment of the present invention will be described with a specific example.

Figure 6:
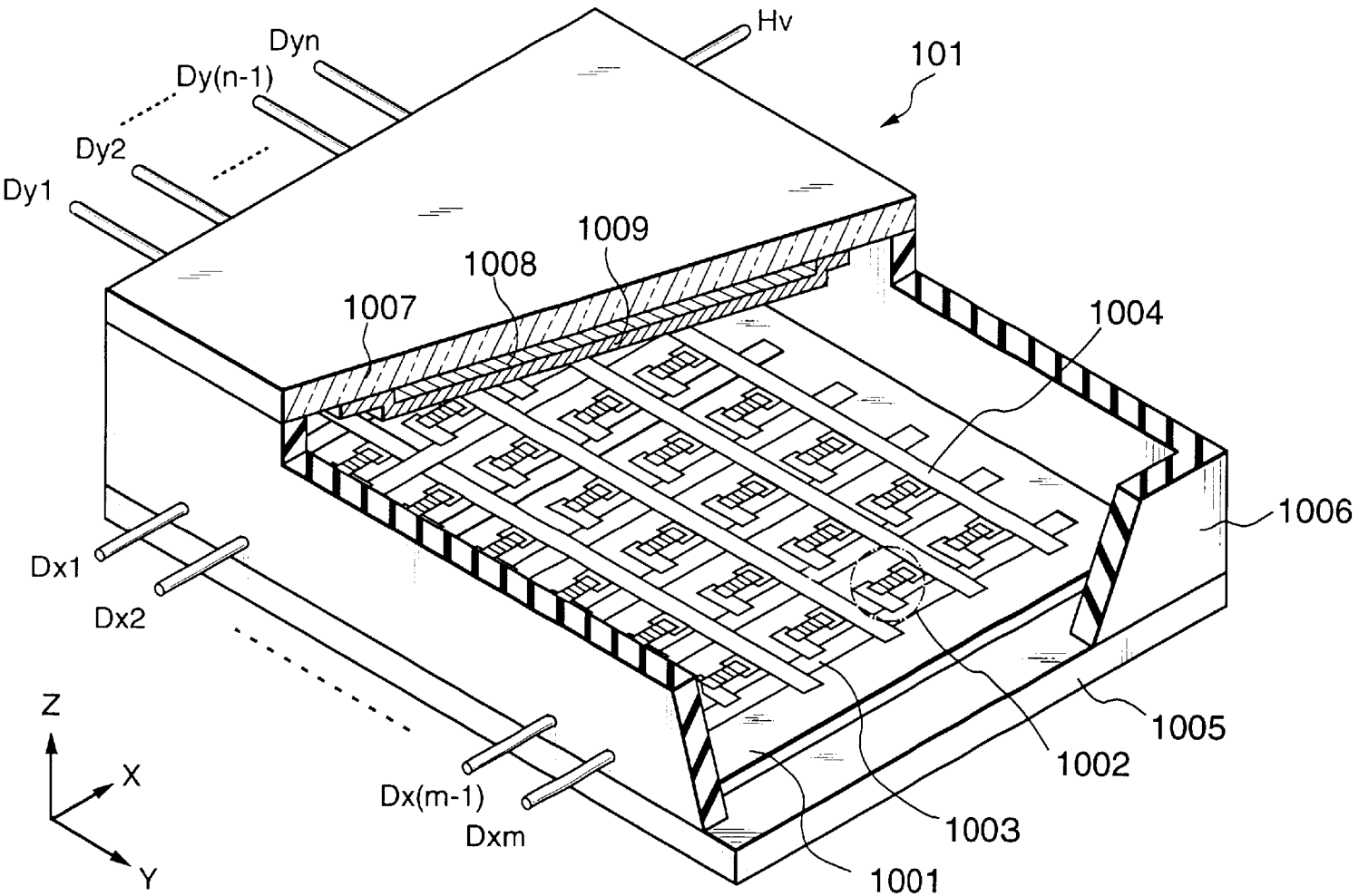
FIG. 6 is a partially cutaway perspective view of a display panel of an image display apparatus according to the present embodiment.

FIG. 6 is a partially cutaway perspective view of a display panel 101 according to the present embodiment, showing the internal structure of the panel.

In FIG. 6, reference numeral 1005 denotes a rear plate; 1006, a side wall; and 1007, a face plate. These parts 1005 to 1007 construct an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400° C. to 500° C. in air or nitrogen atmosphere, thus the parts are seal-connected. A method for exhausting air from the inside of the container will be described later.

The rear plate 1005 has a substrate 1001 fixed thereon, on which n×m cold cathode devices 1002 are formed (m, n=positive integer equal to 2 or more, properly set in accordance with a desired number of display pixels. For example, in a display apparatus for high-resolution television display, preferably n=3,000 or more, m=1,000 or more. In the present embodiment, n=3,072, m=1,024.) The n×m cold cathode devices are arranged in a simple matrix with m row-direction wirings 1003 and n column-direction wirings 1004. The portion constituted by the components denoted by references 1001 to 1004 will be referred to as a multi-electron source. The manufacturing method and structure of the multi-electron source will be described in detail later.

In this embodiment, the substrate 1001 of the multi-electron source is fixed to the rear plate 1005 of the airtight container. If, however, the substrate 1001 of the multi-electron source has sufficient strength, the substrate 1001 of the multi-electron source may also serve as the rear plate of the airtight container.

Figure 7A:
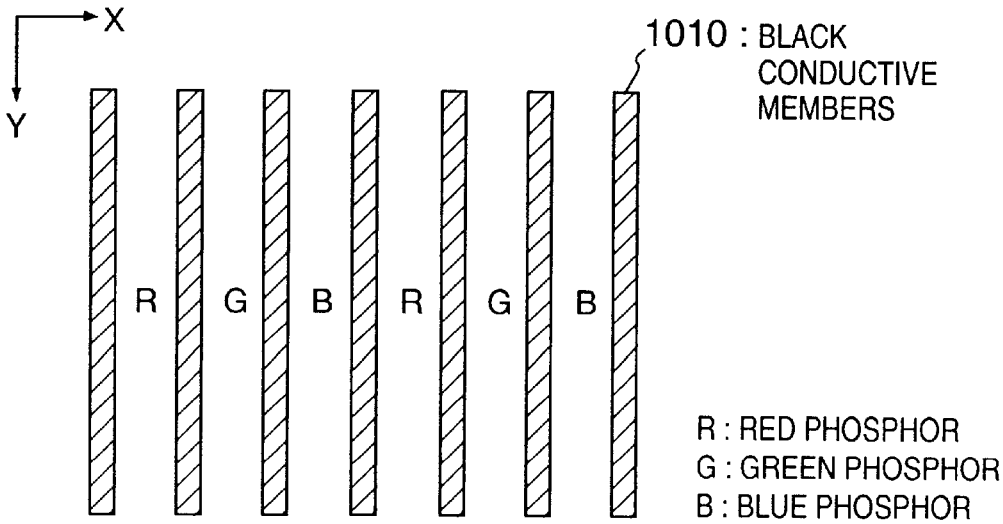
FIGS. 7A and 7B are plan views showing arrays of phosphors of a face plate of the display panel according to the present embodiment.

A fluorescent film 1008 is formed on the lower surface of the face plate 1007. As this embodiment is a color display apparatus, the fluorescent film 1008 is coated with red, green, and blue phosphors, i.e., three primary color phosphors used in the CRT field. As shown in FIG. 7A, the respective color phosphors are formed into a striped structure, and black conductive members 1010 are provided between the stripes of the phosphors. The purpose of providing the black conductive members 1010 is to prevent display color misregistration even if the electron-beam irradiation position is shifted to some extent, to prevent degradation of display contrast by shutting off reflection of external light, to prevent the charge-up of the fluorescent film by the electron beam, and the like. As a material for the black conductive members 1010, graphite is used as a main component, but other materials may be used so long as the above purpose is attained.

Figure 7B:
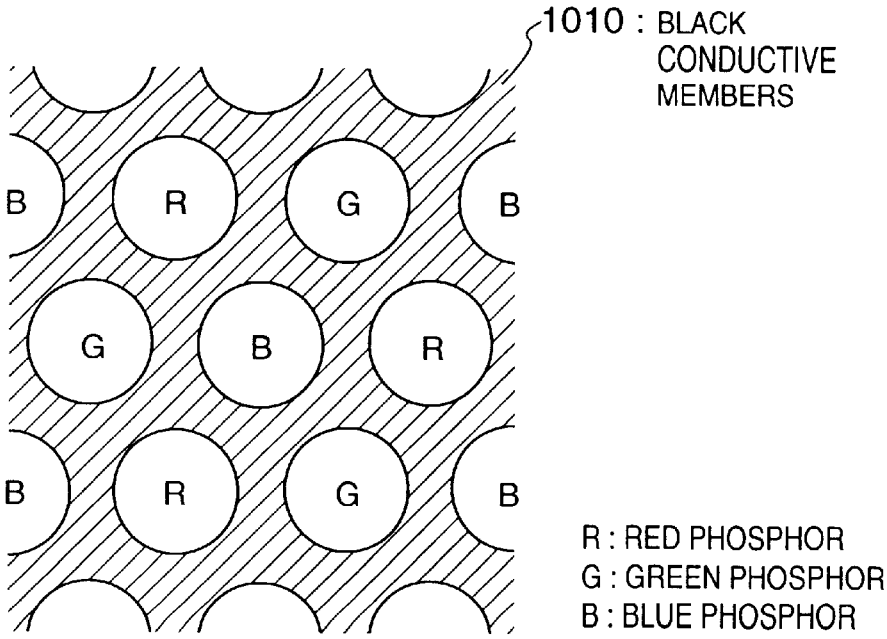

Further, the three-primary colors of the fluorescent film are not limited to the stripes as shown in FIG. 7A. For example, delta arrangement as shown in FIG. 7B or any other arrangement may be employed.

Note that when a monochrome display panel is formed, a single-color fluorescent substance may be applied to the fluorescent film 1008, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing aluminum (Al) thereon by vacuum deposition. Note that when fluorescent substance for a low voltage is used for the fluorescent film 1008, the metal back 1009 is not used.

Furthermore, for application of an accelerating voltage or improvement of the conductivity of the fluorescent film, transparent electrodes made of, e.g., ITO may be provided between the face plate substrate 1007 and the fluorescent film 1008, although such electrodes are not used in this embodiment.

Dx1 to Dxm, Dy1 to Dyn, and Hv are electric connection terminals for an airtight structure provided to electrically connect the display panel to an electric circuit (not shown). Dx1 to Dxm are electrically connected to the row-direction wirings 1003 of the multi-electron source; Dy1 to Dyn, to the column-direction wirings 1004 of the multi-electron source; and Hv, to the metal back 1009 of the face plate.

To evacuate the airtight container, after forming the airtight container, an exhaust pipe and a vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by heating or RF heating. The suction effect of the getter film maintains a vacuum of $1\times10^{-5}$ or $1\times10^{-7}$ Torr in the container.

The basic arrangement and manufacturing method of the display panel according to the first embodiment of the present invention have been briefly described above.

A method of manufacturing the multi-electron source used in the display panel of this embodiment will be described below. In manufacturing the multi-electron source used in the image display apparatus of the present invention, any material, shape, and manufacturing method for cold cathode device devices may be employed as long as an electron source can be obtained by arranging cold cathode devices in a simple matrix. Therefore, cold cathode devices such as surface-conduction-type emitting devices, FE type devices, or MIM type devices can be used.

Under circumstances where inexpensive display apparatuses having large display areas are required, a surface-conduction-type emitting device, of these cold cathode devices, is especially preferable. More specifically, the electron emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, a surface-conduction-type emitting device can be manufactured by a relatively simple manufacturing method, and hence an increase in display area and a decrease in manufacturing cost can be attained. The present inventor has also found that among the surface-conduction-type emitting devices, an electron beam source having an electron emitting portion or its peripheral portion consisting of a fine particle film is excellent in electron emitting characteristic and can be easily manufactured. Such a device can therefore be most suitably used for the multi-electron source of a high-brightness, large-screen image display apparatus. For this reason, in the display panel 101 of this embodiment, surface-conduction-type emitting devices each having an electron emitting portion or its peripheral portion made of a fine particle film are used. The basic structure, manufacturing method, and characteristics of the preferred surface-conduction-type emitting device will be described first. The structure of the multi-electron source having many devices arranged in a simple matrix will be described later.

Preferred Structure and Manufacturing Method of Surface-Conduction-Type Emitting Device Typical examples of surface-conduction-type emitting devices each having an electron emitting portion or its peripheral portion made of a fine particle film include two types of devices, namely flat and step type devices.

Flat Surface-Conduction-Type Emitting Device

First, the structure and manufacturing method of a flat surface-conduction-type emitting device will be described.

Figure 8A:
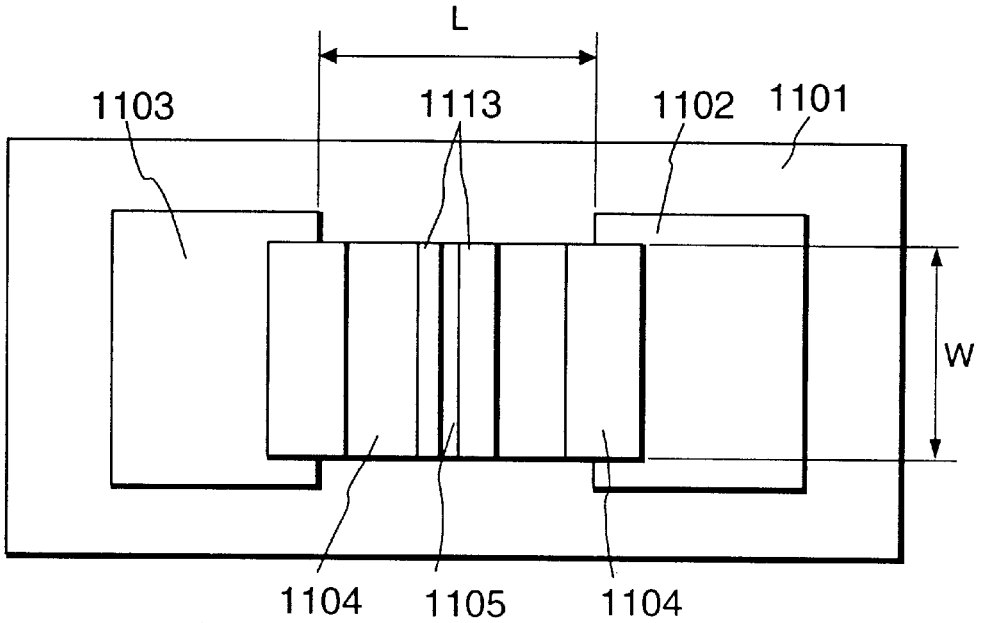
FIG. 8A is a plan view of a flat surface-conduction-type emitting device.
Figure 8B:
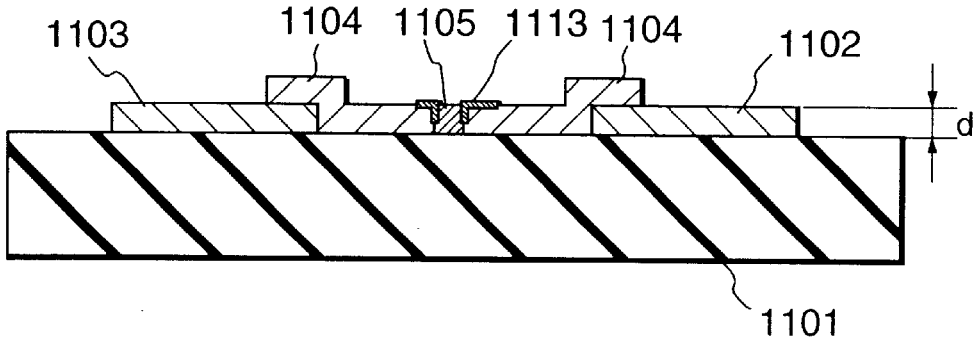
FIG. 8B is a cross section of the flat surface-conduction-type emitting device.

FIG. 8A is a plan view and FIG. 8B is a cross section of the flat surface-conduction-type emitting device according to the present embodiment.

Referring to FIGS. 8A and 8B, reference numeral 1101 denotes a substrate; 1102 and 1103, device electrodes; 1104, a conductive thin film; 1105, an electron emitting portion formed by the forming processing; and 1113, a thin film formed by the activation processing. As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron emitting device. Generally, an interval L between electrodes is designed by selecting an appropriate value in a range from hundreds angstroms to hundreds micrometers. The most preferable range for a display apparatus is from several micrometers to ten micrometers. As for electrode thickness d, an appropriate value is selected in a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several angstroms to thousand angstroms. Preferably, the diameter is within a range from 10 angstroms to 200 angstroms. The thickness of the fine particle film is appropriately set in consideration of conditions as follows. That is, the condition necessary for electrical connection to the device electrode 1102 or 1103, the condition for the forming processing to be described later, the condition for setting electrical resistance of the fine particle film itself to an appropriate value to be described later etc. Specifically, the thickness of the film is set in a range from several angstroms to thousand angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. Any appropriate material(s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIGS. 8A and 8B, the respective parts are overlapped in order of, the substrate, the device electrodes, and the conductive thin film, from the bottom. This overlapping order may be the substrate, the conductive thin film, and the device electrodes, from the bottom.

The electron emitting portion 1105 is a fissured portion formed at a part of the conductive thin film 1104. The electron emitting portion 1105 has a resistance characteristic higher than peripheral conductive thin film. The fissure is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron emitting portion, therefore, FIGS. 8A and 8B show the fissured portion schematically.

The thin film 1113, which comprises carbon or carbon compound material, covers the electron emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIGS. 8A and 8B show the film schematically. FIG. 8A shows the device where a part of the thin film 1113 is removed.

The preferred basic structure of the surface-conduction-type emitting device is as described above. In the embodiment, the device has the following constituents.

That is, the substrate 1101 comprises a soda-lime glass, and the device electrodes 1102 and 1103, an Ni thin film. The electrode thickness d is 1,000 angstroms and the electrode interval L is 2 $\mu$m. The main material of the fine particle film is Pd or PdO. The thickness of the fine particle film is about 100 angstroms, and its width W is 100 $\mu$m.

Next, a method of manufacturing a preferred flat surface-conduction-type emitting device will be described with reference to FIGS. 9A to 9D, which are sectional views showing the manufacturing processes of the surface-conduction-type emitting device. Note that reference numerals are the same as those in FIGS. 8A and 8B.

Figure 9A:
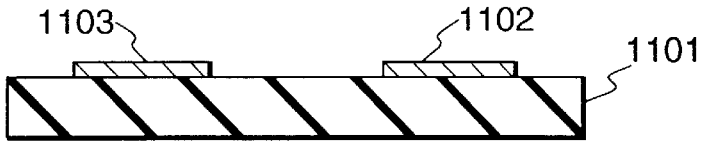
FIGS. 9A to 9E are cross sections explaining manufacturing steps of a flat surface-conduction-type emitting device according to the present embodiment.

1) First, as shown in FIG. 9A, the device electrodes 1102 and 1103 are formed on the substrate 1101. To form these device electrodes 1102 and 1103, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes (1102 and 1103) shown in FIG. 9A is formed.

Figure 9B:
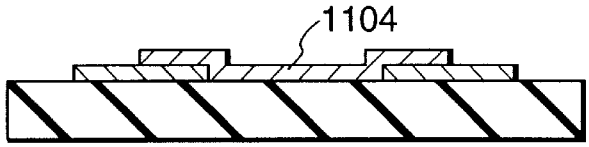

2) Next, as shown in FIG. 9B, the conductive thin film 1104 is formed. To form the conductive thin film 1104, first, an organic metal solvent is applied to the substrate in FIG. 9A, then the applied solvent is dried and sintered, thus forming a fine particle film. Thereafter, the fine particle film is patterned into a predetermined shape by the photolithography etching method. The organic metal solvent means a solvent of organic metal compound containing material of minute particles, used for forming the conductive thin film, as a main component. (More specifically, Pd is used in this embodiment. In the embodiment, application of organic metal solvent is made by dipping, however, any other method such as a spinner method and spraying method may be employed.)

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 9C:
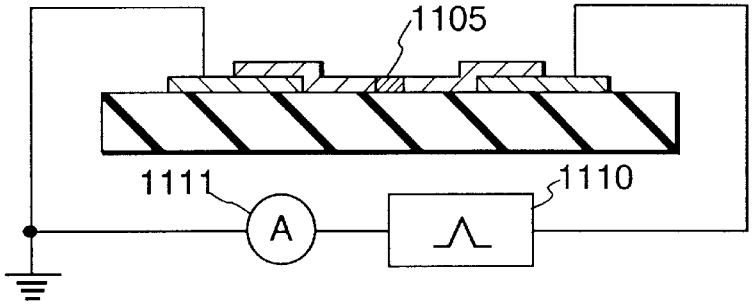

3) Then, as shown in FIG. 9C, appropriate voltage is applied between the device electrodes 1102 and 1103, from a power source 1110 for the forming processing, then the forming processing is performed, thus forming the electron emitting portion 1105.

The forming processing here is electric energization of a conductive thin film 1104, formed by a fine particle film, to appropriately destroy, deform, or deteriorate a part of the conductive thin film, thus changing the film to have a structure suitable for electron emission. In the conductive thin film made of the fine particle film, the portion changed for electron emission (i.e., electron emitting portion 1105) has an appropriate fissure in the thin film. Comparing the thin film 1104 having the electron emitting portion 1105 with the thin film before the forming processing, the electrical resistance measured between the device electrodes 1102 and 1103 has greatly increased.

Figure 10:
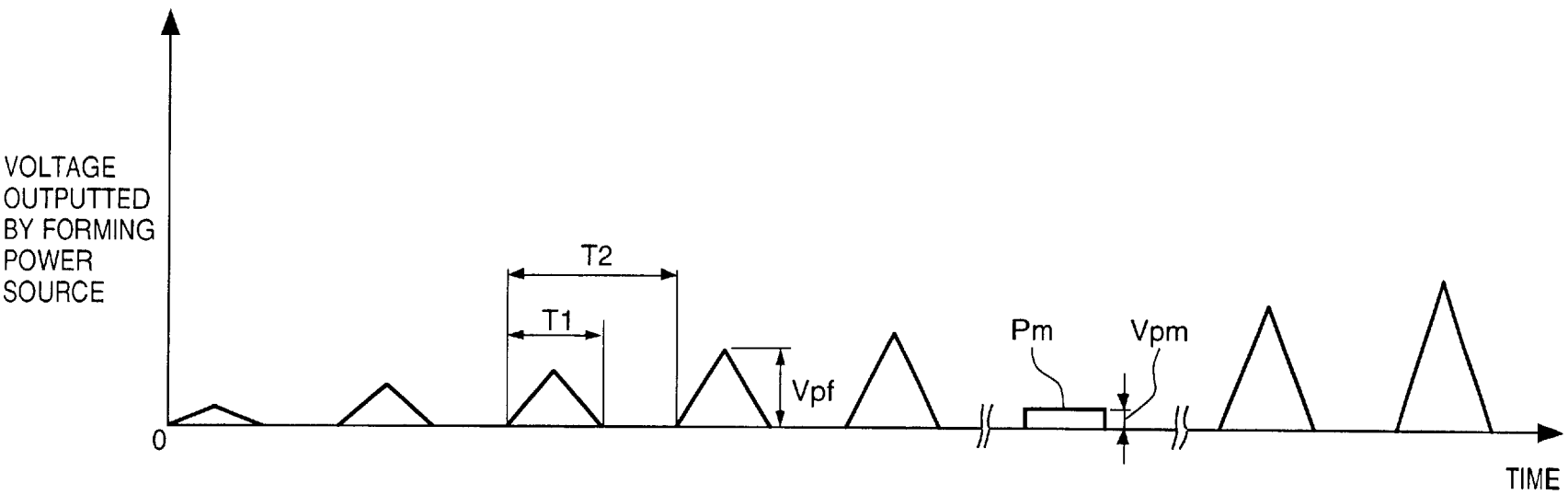
FIG. 10 is a graph showing a waveform of voltage applied at the time of energization forming processing.

The electrification method will be explained in more detail with reference to FIG. 10, showing an example of waveform of appropriate voltage applied from the forming power source 1110. Preferably, in case of forming a conductive thin film of a fine particle film, a pulse-like voltage is employed. In this embodiment, as shown in FIG. 10, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the electron emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electrical resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the surface-conduction-type emitting device of this embodiment. In case of changing the design of the surface-conduction-type emitting device concerning, e.g., the material or thickness of the fine particle film, or the device electrode interval L, the conditions for electrification are preferably changed in accordance with the change of device design.

Figure 9D:
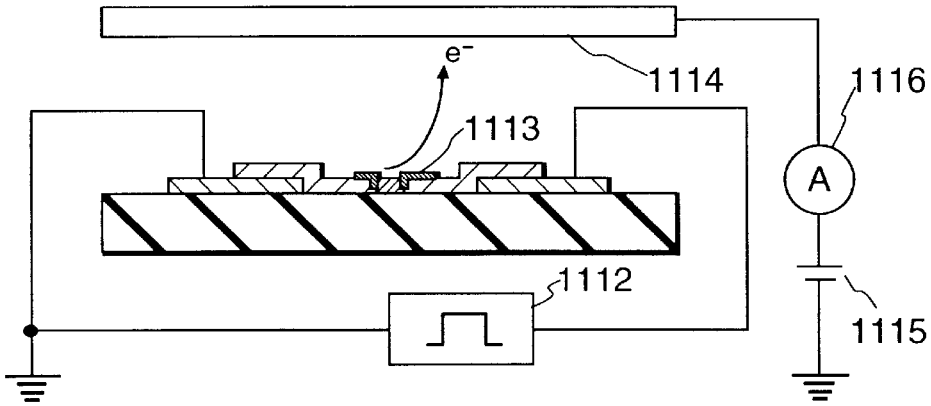

(4) Next, as shown in FIG. 9D, appropriate voltage is applied, from an activation power source 1112, between the device electrodes 1102 and 1103, and the activation processing is performed to improve electron emitting characteristic.

The activation processing here is electrification of the electron emitting portion 1105 formed by the forming processing, on appropriate condition(s), for depositing carbon or carbon compound around the electron emitting portion 1105. (In FIG. 9D, the deposited material of carbon or carbon compound is shown as material 1113.) Comparing the electron emitting portion 1105 with that before the activation processing, the emission current at the same application voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 11A:
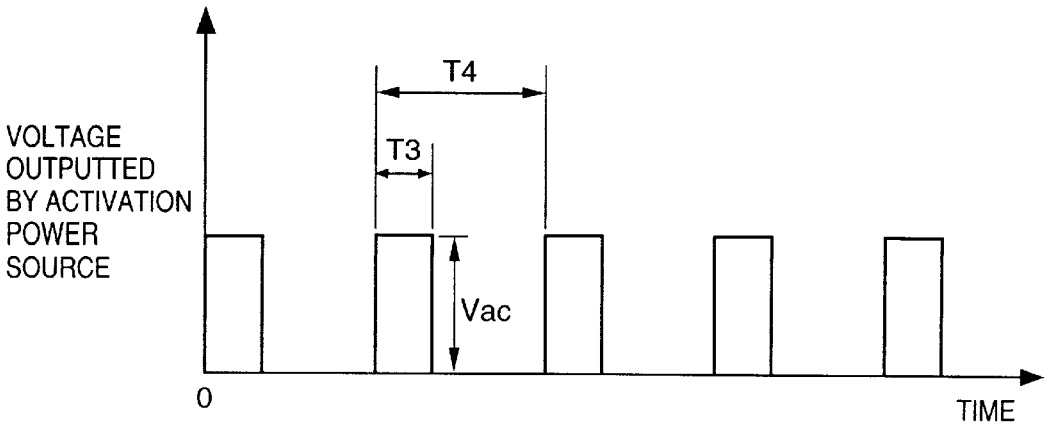
FIG. 11A is a graph showing a waveform of voltage applied at the time of activation processing.
Figure 11B:
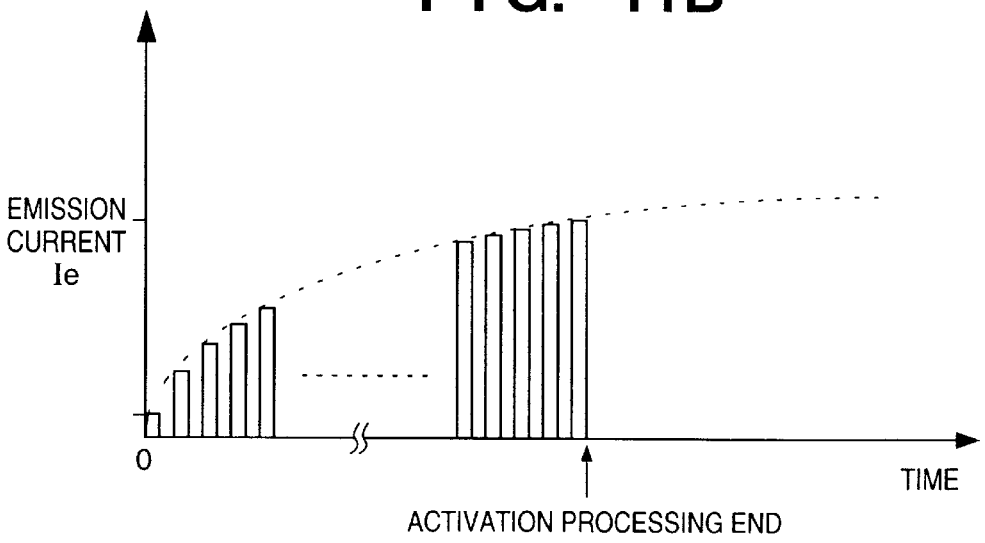
FIG. 11B is a graph showing variance in an emission current Ie.

The electrification method will be described in more detail with reference to FIG. 11A, showing an example of waveform of appropriate voltage applied from the activation power source 1112. In this embodiment, the activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction-type emitting device of the embodiment. In the case in which the design of the surface-conduction-type emitting device is changed, the electrification conditions are preferably changed in accordance with the change of device design.

In FIG. 9D, reference numeral 1114 denotes an anode electrode, connected to a direct-current (DC) high-voltage power source 1115 and a galvanometer 1116, for capturing emission current Ie emitted from the surface-conduction-type emitting device. (In the case in which the substrate 1101 is incorporated into the display panel before the activation processing, the Al layer on the fluorescent surface of the display panel is used as the anode electrode 1114.) While applying voltage from the activation power source 1112, the galvanometer 1116 measures the emission current Ie, thus monitoring the progress of activation processing, to control the operation of the activation power source 1112. FIG. 9B shows an example of the emission current Ie measured by the galvanometer 1116. As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction-type emitting device of the embodiment. In case of changing the design of the surface-conduction-type emitting device, the conditions are preferably changed in accordance with the change of device design.

Figure 9E:
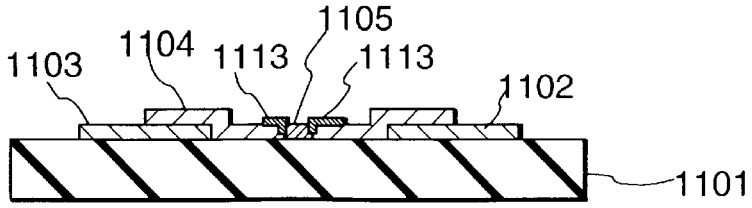

As described above, the surface-conduction-type emitting device as shown in FIG. 9E is manufactured.

Step Surface-Conduction-Type Emitting Device

Next, another typical structure of the surface-conduction-type emitting device where an electron emitting portion or its peripheral portion is formed of a fine particle film, i.e., a stepped surface-conduction-type emitting device will be described.

Figure 12:
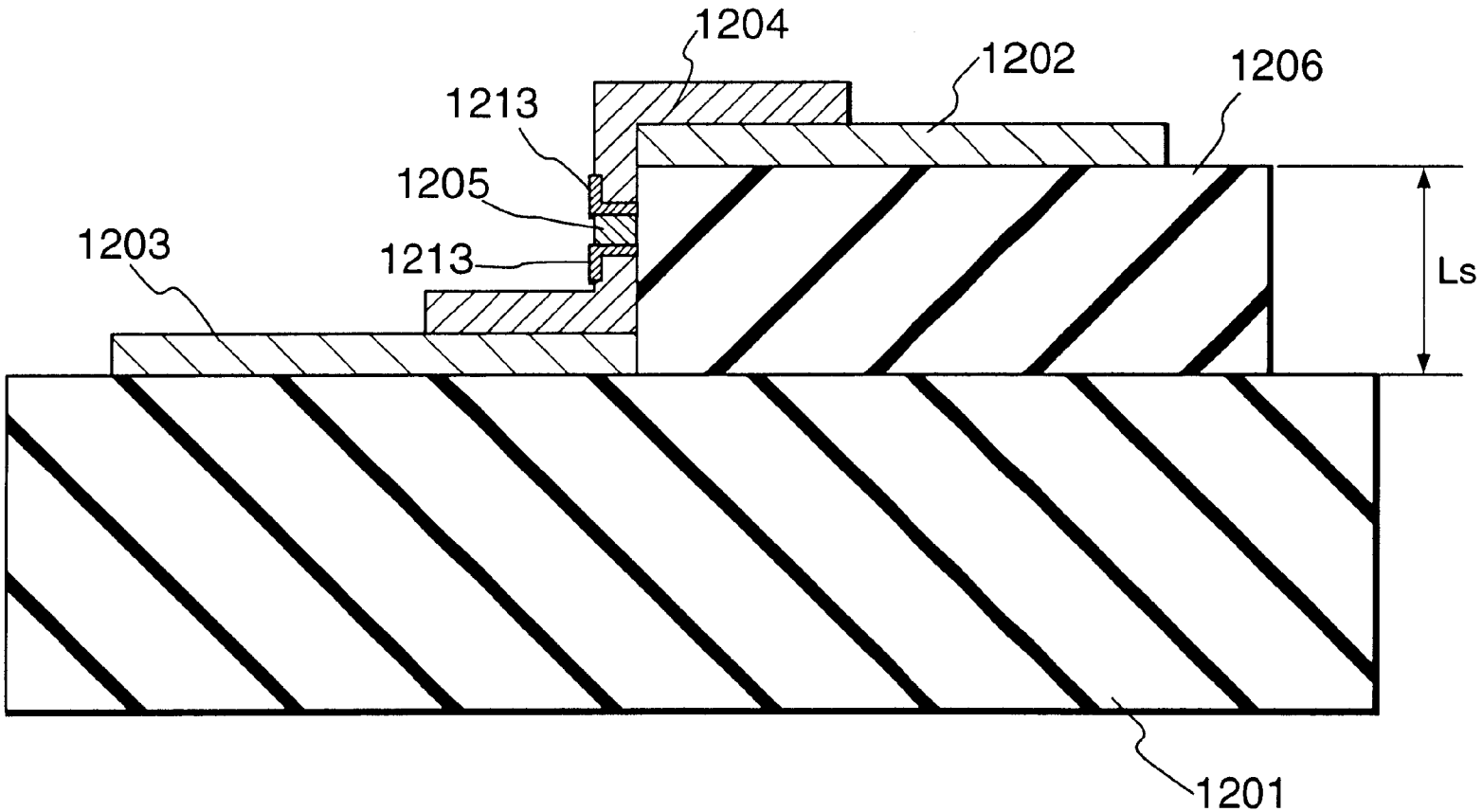
FIG. 12 is a sectional view of a step surface-conduction-type emitting device according to the present embodiment.

FIG. 12 is a sectional view schematically showing the basic construction of the step surface-conduction-type emitting device according to the present embodiment. Referring to FIG. 12, reference numeral 1201 denotes a substrate; 1202 and 1203, device electrodes; 1206, a step-forming member for making height difference between the electrodes 1202 and 1203; 1204, a conductive thin film using a fine particle film; 1205, an electron emitting portion formed by the forming processing; and 1213, a thin film formed by the activation processing.

The difference between the step device from the above-described flat device is that one of the device electrodes (1202 in this example) is provided on the step-forming member 1206 and the conductive thin film 1204 covers the side surface of the step-forming member 1206. The device interval L in FIG. 9A is set in this structure as a height difference Ls corresponding to the height of the step-forming member 1206. Note that the substrate 1201, the device electrodes 1202 and 1203, the conductive thin film 1204 using the fine particle film can comprise the materials given in the explanation of the flat surface-conduction-type emitting device. Further, the step-forming member 1206 comprises electrically insulating material such as $SiO_2$.

Next, a method of manufacturing the stepped surface-conduction-type emitting device will be described.

FIGS. 13A to 13F are sectional views showing the manufacturing processes. In these drawings, reference numerals of the respective parts are the same as those in FIG. 10.

Figure 13A:
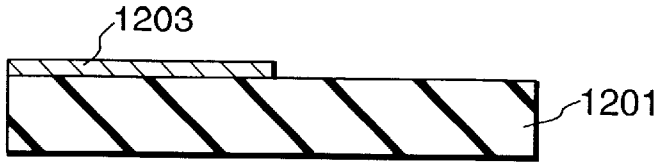
FIGS. 13A to 13F are cross sections explaining manufacturing steps of a step surface-conduction-type emitting device according to the present embodiment.

(1) First, as shown in FIG. 13A, the device electrode 1203 is formed on the substrate 1201.

Figure 13B:
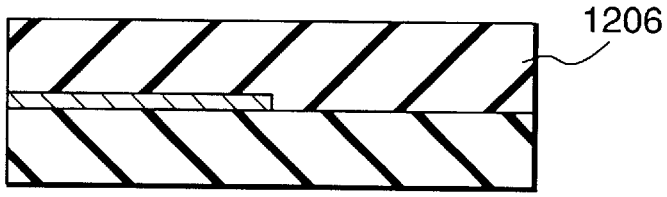

(2) Next, as shown in FIG. 13B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 13C:
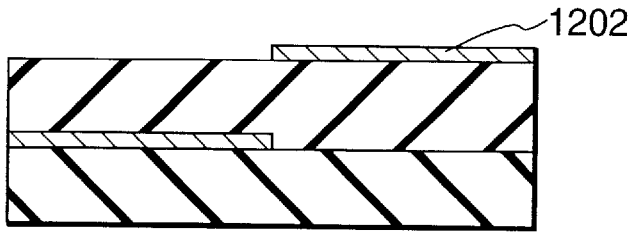

(3) Next, as shown in FIG. 13C, the device electrode 1202 is formed on the insulating layer.

Figure 13D:
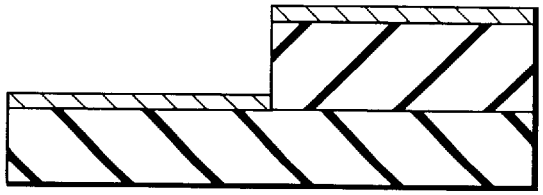

(4) Next, as shown in FIG. 13D, a part of the insulating layer is removed by using, e.g., an etching method, to expose the device electrode 1203.

Figure 13E:
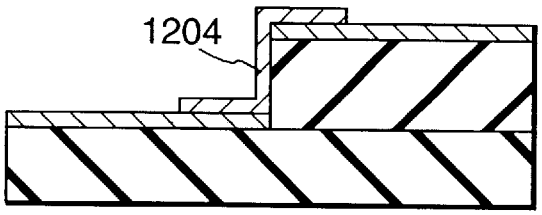

(5) Next, as shown in FIG. 13E, the conductive thin film 1204 using the fine particle film is formed. Upon formation, similar to the above-described flat device structure, a film-forming technique such as an applying method is used.

(6) Next, similar to the flat device structure, the forming processing is performed to form an electron emitting portion. (The forming processing similar to that explained using FIG. 9C may be performed.)

(7) Next, similar to the flat device structure, the activation processing is performed to deposit carbon or carbon compound around the electron emitting portion. (Activation processing similar to that explained using FIG. 9D may be performed).

Figure 13F:
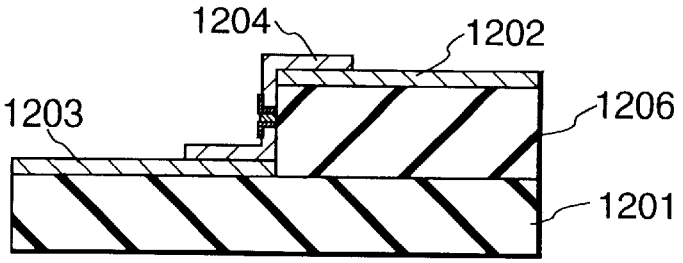

As described above, the stepped surface-conduction-type emitting device shown in FIG. 13F is manufactured.

Characteristic of Surface-Conduction-Type Emitting Device Used in Display Apparatus The structure and manufacturing method of the flat surface-conduction-type emitting device and those of the stepped surface-conduction-type emitting device are as described above. Next, the characteristic of the electron emitting device used in the display apparatus will be described below.

FIG. 14 shows a typical example of (emission current Ie) to (device voltage (i.e., voltage to be applied to the device) Vf) characteristic and (device current If) to (device application voltage Vf) characteristic of the surface-conduction-type emitting device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 14 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases. However, with voltage lower than the threshold voltage Vth, almost no emission current Ie is detected. That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf to the device. Accordingly, an electrical charge amount of electrons to be emitted from the device can be controlled by changing period of application of the device voltage Vf.

The surface-conduction-type emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device in accordance with a desired emission luminance, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

Structure of Multi-Electron Source With Many Devices Arranged in Simple Matrix Next, the structure of the multi-electron source having the above-described surface-conduction-type emitting devices arranged on the substrate with the simple-matrix wiring will be described below.

Figure 15:
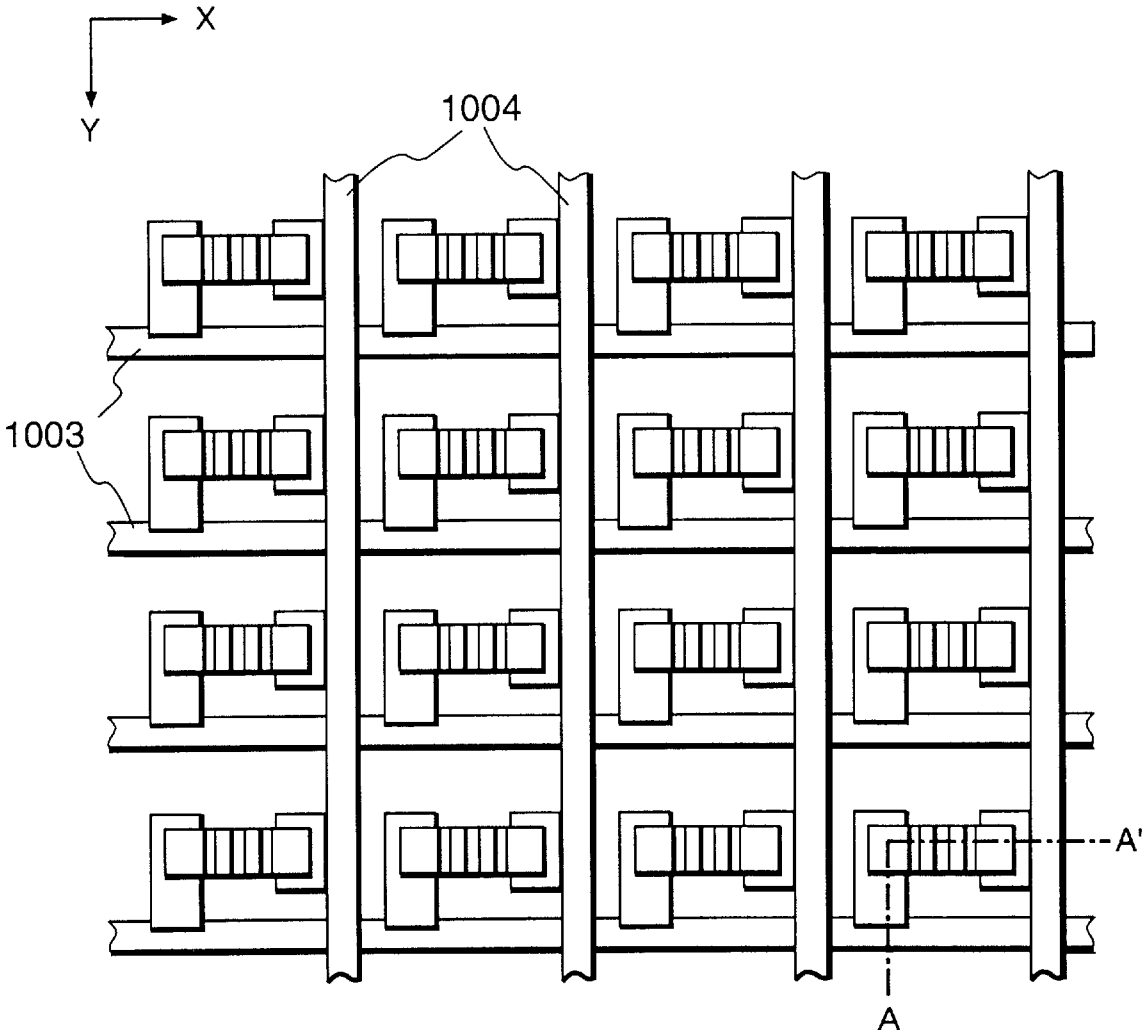
FIG. 15 is a plan view of a substrate of a multi-electron source employed in the present embodiment.

FIG. 15 is a plan view of the multi-electron source used in the display panel in FIG. 6. There are surface-conduction-type emitting devices like the one shown in FIGS. 9A and 9B on a substrate. These devices are arranged in a simple matrix with the row-direction wiring 1003 and the column-direction wiring 1004. At an intersection of the wirings 1003 and 1004, an insulating layer (not shown) is formed between the wires, to maintain electrical insulation.

Figure 16:
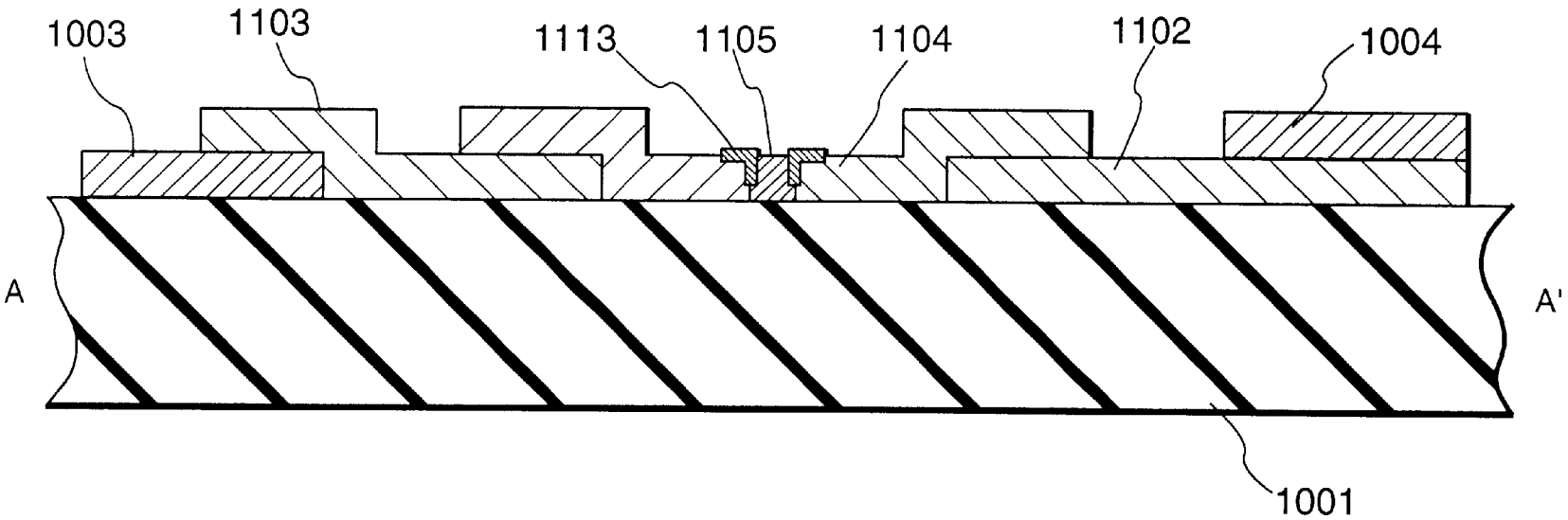
FIG. 16 is a partial cross section of the substrate of the multi-electron source employed in the present embodiment.

FIG. 16 shows a cross-section cut out along the line A–A' in FIG. 15.

Note that a multi-electron source having such structure is manufactured by forming the row- and column-direction wirings 1003 and 1004, the inter-electrode insulating layers (not shown), and the device electrodes and conductive thin films of the surface-conduction-type emitting devices on the substrate, then supplying electricity to the respective devices via the row- and column-direction wirings 1003 and 1004, thus performing the forming processing and the activation processing.

FIG. 17 is a block diagram showing an example of a multi-functional display apparatus capable of displaying image information provided from various image information sources such as television broadcasting on a display panel using the surface-conduction-type emitting device of this embodiment as an electron-beam source.

Referring to FIG. 17, reference numeral 101 denotes a display panel; 2101, a driving circuit for the display panel 101; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion. Note that in the display apparatus, upon reception of a signal containing both video information and audio information such as a TV signal, the video information is displayed while the audio information is reproduced. A description of a circuit or speaker for reception, division, reproduction, processing, storage, or the like of the audio information, which is not directly related to the features of the present invention, will be omitted.

The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take the advantages of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104. The TV signal reception circuit 2112 receives a TV image signal transmitted using a wire transmission system such as a coaxial cable or optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or image read scanner, and outputs it to the decoder 2104. The image memory interface circuit 2110 receives an image signal stored in a video tape recorder (to be briefly referred to as a VTR hereinafter), and outputs it to the decoder 2104. The image memory interface circuit 2109 receives an image signal stored in a video disk, and outputs it to the decoder 2104. The image memory interface circuit 2108 receives an image signal from a device storing still image data such as a so-called still image disk, and outputs the received still image data to the decoder 2104.

The I/O interface circuit 2105 connects the display apparatus to an external computer, computer network, or output device such as a printer. The I/O interface circuit 2105 allows inputting/outputting image data, character data, and graphic information, and in some cases inputting/outputting a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing. Display image data generated by the circuit 2107 is output to the decoder 2104. In some cases, display image data can also be input/output from/to an external computer network or printer via the I/O interface circuit 2105.

The CPU 2106 mainly performs control of operation of this display apparatus, and operations about generation, selection, and editing of display images. For example, the CPU 2106 outputs a control signal to the multiplexer 2103 to properly select or combine image signals to be displayed on the display panel. At this time, the CPU 2106 generates a control signal to the display panel controller 2102 in accordance with the image signals to be displayed, and appropriately controls operation of the display apparatus in terms of the screen display frequency, the scanning method (e.g., interlaced or non-interlaced scanning), the number of scanning lines for one frame, and the like. The CPU 2106 directly outputs image data or character/graphic information to the image generation circuit 2107. In addition, the CPU 2106 accesses an external computer or memory via the I/O interface circuit 2105 to input image data or character/graphic information. The CPU 2106 may also be concerned with operations for other purposes. For example, the CPU 2106 can be directly concerned with the function of generating and processing information, like a personal computer or wordprocessor. Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse.

The decoder 2104 inversely converts various image signals input from the circuits 2107 to 2113 into three primary color signals, or a luminance signal and I and Q signals. As is indicated by the dotted line in FIG. 18, the decoder 2104 desirably incorporates an image memory in order to process a TV signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and CPU 2106.

The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, the image signals can be selectively switched within a 1-frame display time to display different images in a plurality of areas of one frame, like a so-called multiwindow television.

The display panel controller 2102 controls operation of the driving circuit 2101 on the basis of a control signal input from the CPU 2106. As for the basic operation of the display panel 101, the display panel controller 2102 outputs, e.g., a signal for controlling the operation sequence of a driving power source (not shown) of the display panel 101 to the driving circuit 2101. As for the method of driving the display panel 101, the display panel controller 2102 outputs, e.g., a signal for controlling the screen display frequency or scanning method (e.g., interlaced or non-interlaced scanning) to the driving circuit 2101. In some cases, the display panel controller 2102 outputs to the driving circuit 2101 a control signal about adjustment of the image quality such as the brightness, contrast, color tone, or sharpness of a display image.

The driving circuit 2101 generates a driving signal to be applied to the display panel 101, and operates based on an image signal input from the multiplexer 2103 and a control signal input from the display panel controller 2102.

The functions of the respective parts have been described. The arrangement of the display apparatus shown in FIG. 17 makes it possible to display image information input from various image information sources on the display panel 101. More specifically, various image signals such as television broadcasting image signals are inversely converted by the decoder 2104, appropriately selected by the multiplexer 2103, and supplied to the driving circuit 2101. On the other hand, the display controller 2102 generates a control signal for controlling operation of the driving circuit 2101 in accordance with an image signal to be displayed. The driving circuit 2101 applies a driving signal to the display panel 101 on the basis of the image signal and control signal. As a result, the image is displayed on the display panel 101. A series of operations are systematically controlled by the CPU 2106.

In the display apparatus, the image memory incorporated in the decoder 2104, the image generation circuit 2107, and the CPU 2106 can cooperate with each other to simply display selected ones of a plurality of pieces of image information and to perform, for the image information to be displayed, image processing such as enlargement, reduction, rotation, movement, edge emphasis, thinning, interpolation, color conversion, and conversion of the aspect ratio of an image, and image editing such as synthesis, erasure, connection, exchange, and pasting. Although not described in this embodiment, an audio circuit for processing and editing audio information may be arranged, similar to the image processing and the image editing.

The display apparatus can therefore function as a display device for television broadcasting, a terminal device for video conferences, an image editing device for processing still and dynamic images, a terminal device for a computer, an office terminal device such as a wordprocessor, a game device, and the like. This display apparatus is useful for industrial and business purposes and can be variously applied.

FIG. 17 merely shows an example of the arrangement of the display apparatus using the display panel 101 having the surface-conduction-type emitting device as an electron source. The present invention is not limited to this, as a matter of course. For example, among the constituents in FIG. 17, a circuit associated with a function unnecessary for the application purpose can be eliminated from the display apparatus. To the contrary, another constituent can be added to the display apparatus in accordance with the application purpose. For example, when the display apparatus is used as a television telephone set, transmission and reception circuits including a television camera, audio microphone, lighting, and modem are preferably added as constituents.

In the display apparatus, since particularly the display panel using the surface-conduction-type emitting device as an electron source can be easily made thin, the width of the whole display apparatus can be decreased. In addition to this, the display panel using the surface-conduction-type emitting device as an electron source is easily increased in screen size and has a high brightness and a wide view angle. This display apparatus can therefore display an impressive image with reality and high visibility.

[Third Embodiment]

Figure 18:
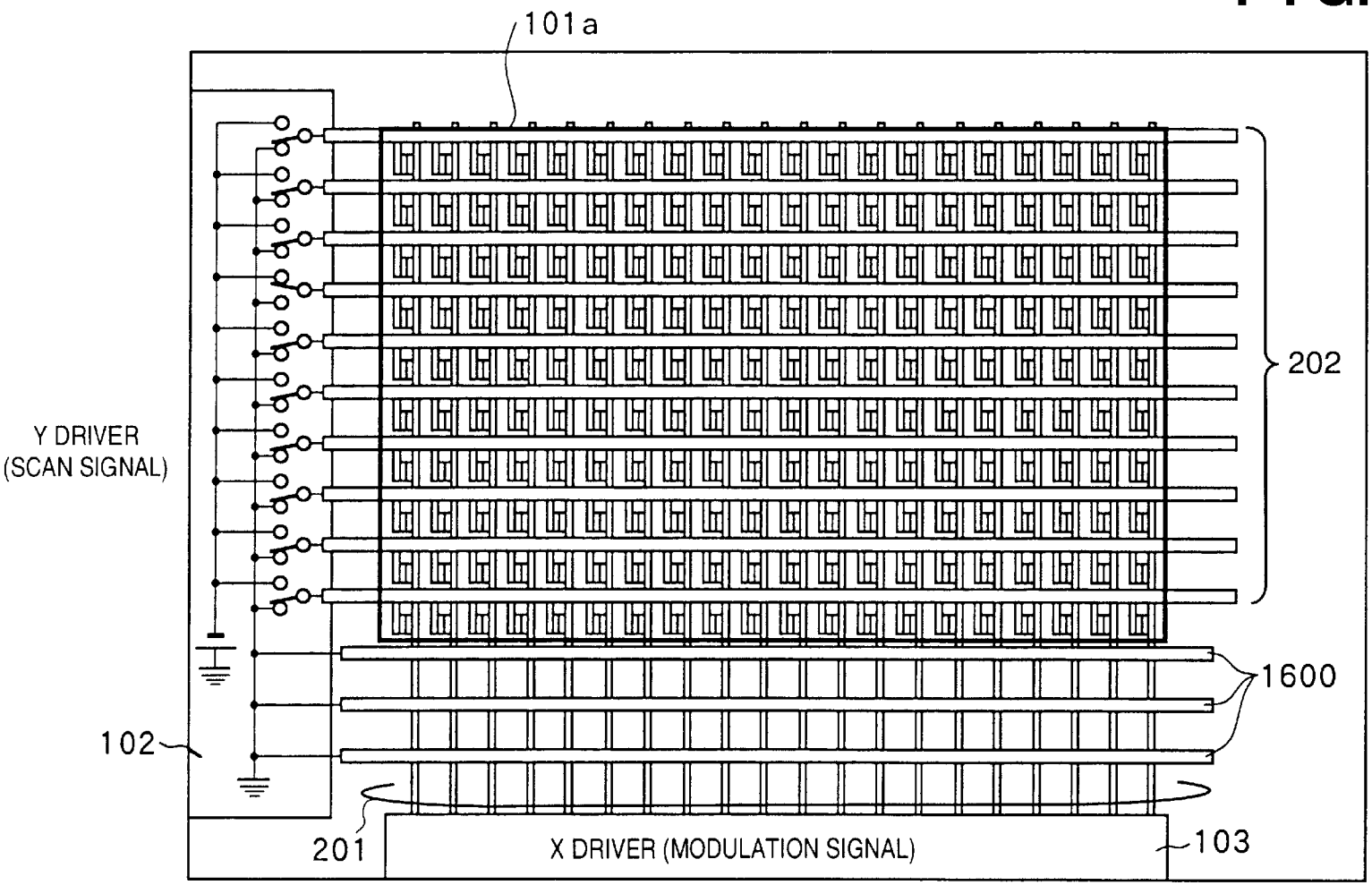
FIG. 18 is an explanatory view showing connections between a display panel and peripheral circuits according to a third embodiment of the present invention.

FIG. 18 shows a construction of the third embodiment of the present invention.

FIG. 18 shows a part of an image display apparatus where a display panel 101 and X and Y drivers 102 and 103 are connected through connection wirings of the display panel 101. The image display apparatus in FIG. 18 comprises: the display panel 101 in which surface-conduction-type emitting devices having the (device voltage) to (emission current) characteristic shown in FIG. 14 are arranged in m×n matrix wirings; a Y driver 102 for sequentially scanning row-direction wirings 202 (scan signal wiring) to drive the devices arrayed in an image display area 101*a* of the display panel 101; and an X driver 103 which applies a modulation signal to the column-direction wirings 201 of the display panel 101, to display an image according to an input image signal. Note that the positional relationship between the row-direction wirings 202 and column-direction wirings 201 in the display panel 101 is the same as that described in FIG. 2. Thus, in the display panel 101, the characteristic impedance of the column-direction wirings 201 (modulation signal direction) is mainly dependent on a reactance in the image display area 101*a* of the column-direction wirings 201 (modulation signal wirings) as well as a capacitance generated at an intersection of the column-direction wirings 201 (modulation signal wirings) and row-direction wirings 202 (scan signal wirings). Assuming that the reactance per device of the image display area 101*a* is L, and a capacitance at an intersection of a column-direction wiring 201 (modulation signal wirings) and a row-direction wiring 202 (scan signal wirings) is C, the characteristic impedance Z0 in the direction of the column wirings (modulation signals) is expressed approximately by $Z0 \approx \sqrt{L/C}$.

In the connection wirings of the display panel 101, which are connected to the column-direction wirings 201 (modulation signal wirings), column-direction wirings 1600 (scan signal wirings) are formed in the similar manner to the image display area 101*a* as shown in FIG. 18. By virtue of this, the characteristic impedance in the connection wiring portion has substantially the same value as the characteristic impedance $Z0 \approx \sqrt{L/C}$ in the modulation signal direction.

As described above, by matching the impedance of the connection wirings of the display panel 101, which are connected to the column-direction wirings 201 (modulation signal wirings), with the characteristic impedance of the modulation signal wirings, one of the ringing factors can be eliminated.

As set forth above, according to the third embodiment, by forming row-direction wirings 1600 in the connection wiring portion of the display panel 101, which are connected to the column-direction wirings 201 (modulation signal wirings), in the similar manner to the image display area 101*a* of the display panel 101, the wirings in the connection portion come to have the same construction as the column-direction wirings of the image display area 101a. Naturally, the characteristic impedance has a value similar to that of the column-direction wirings. Accordingly, impedance matching is realized without particularly estimating the characteristic impedance.

[Fourth Embodiment]

Figure 19:
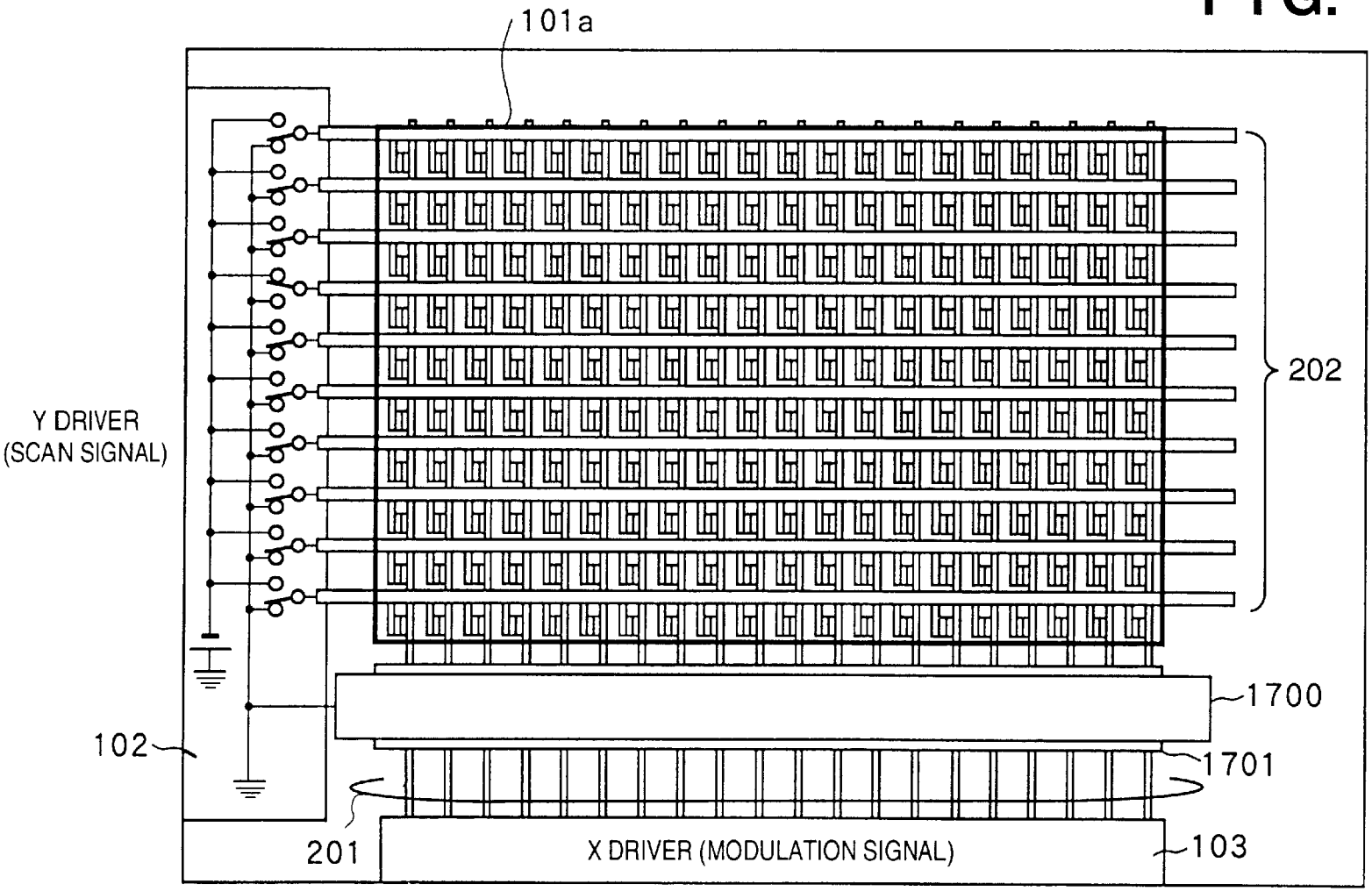
FIG. 19 is an explanatory view showing connections between a display panel and peripheral circuits according to a fourth embodiment of the present invention.

FIG. 19 shows a construction of the fourth embodiment of the present invention. Components common to the above-described drawings are referred to by the same reference numerals and description thereof will be omitted.

The display panel 101 of the present embodiment is similar to the above-described embodiment in that the characteristic impedance Z0 in the modulation signal direction is expressed approximately by $Z0 \approx \sqrt{L/C}$, assuming that the reactance per device of the image display area 101*a* is L, and a capacitance at an intersection of a column-direction wiring 201 (modulation signal wirings) and a row-direction wiring 202 (scan signal wirings) is C.

According to the fourth embodiment, an insulating layer 1701 and row-direction auxiliary wirings 1700 (scan signal wirings) are formed in the connection wirings of the display panel 101 as shown in FIG. 19, which are connected to the column-direction wirings 201 (modulation signal wirings). By virtue of this, the characteristic impedance Z0 in the connection wiring portion has substantially the same value as the characteristic impedance $Z0 \approx \sqrt{L/C}$ in the modulation signal direction.

Accordingly, the impedance of the connection wiring portion of the display panel 101, which is connected to the column-direction wirings 201 (modulation signal wirings), can be matched with the characteristic impedance of the image area of the column-direction wirings 201 (modulation signal wirings), making it possible to eliminate one of the ringing factors.

Hereinafter, a specific example of the display panel 101 is described.

Description will be provided on a matrix-type display panel 101 having 240×720 pixels. Assume that the column-direction wirings 201 in the image display area 101*a* are formed with Ag wirings with the width of 90 μm, thickness of 5 μm, length of 170 mm, and pitch of 290 μm, then on top of the column-direction wirings, at the position corresponding to the row-direction wirings 202, an insulating layer 203 is formed with the width of 460 μm, thickness of 30 μm, length of 220 mm, and relative permittivity of 12, and further on top of the insulating layer 203, row-direction wirings 202 are formed with Ag wirings with the width of 300 μm, thickness of 20 μm, length of 220 mm, and pitch of 650 μm. In this case, the reactance of the column-direction wirings 201 (modulation signal wirings) is about 170 nH, and the capacitance at an intersection of a row-direction wiring 202 and a column-direction wiring 201 is about 0.2 pF. Therefore, the reactance per device of the image display area 101*a* is L=0.71 nH, and the capacitance per device is C=0.2 pF. From these values, the characteristic impedance in the image display area 101*a* of the display panel 101 is roughly calculated to be $Z0 \approx \sqrt{L/C} \approx 60\ \Omega$. Based on the rough calculation, the thickness of the insulating layer 1701 and line width of the row-direction auxiliary wirings 1700 are determined such that the characteristic impedance of the insulating layer 203 on the connection wirings of the display panel 101, which are connected to the column-direction wirings 201 (modulation signal wirings), and the characteristic impedance of the row-direction auxiliary wirings 1700 (scan signal wirings) are approximately 60 Ω.

Herein, assuming that the thickness of the insulating layer 1701 is 30 μm, the same as the thickness of the insulating layer 203 of the image display area 101*a*, the width of the column-direction wirings 201 (modulation signal wirings) is determined to be 90 μm, and the capacitance between the column-direction wirings 201 and row-direction auxiliary wirings 1700 can be approximated to a capacitance generated on a plane plate parallel to the column-direction wirings 201, thus the capacitance (column direction) per unit length becomes approximately equal to the capacitance of the image display area 101*a* of the display panel 101.

As described above, since the characteristic impedance per unit length (column direction) can be made approximately equal to the characteristic impedance of the image display area 101*a*, it has become clear that the characteristic impedance of the image display area 101*a* is not influenced by the width of the row-direction auxiliary wirings 1700. However, in the present embodiment, the row-direction auxiliary wirings 1700 are formed with a metal film which covers the front surface of the connection wirings. Then, one end of the metal film is connected to the ground terminal of the Y driver 102.

[Fifth Embodiment]

Figure 20:
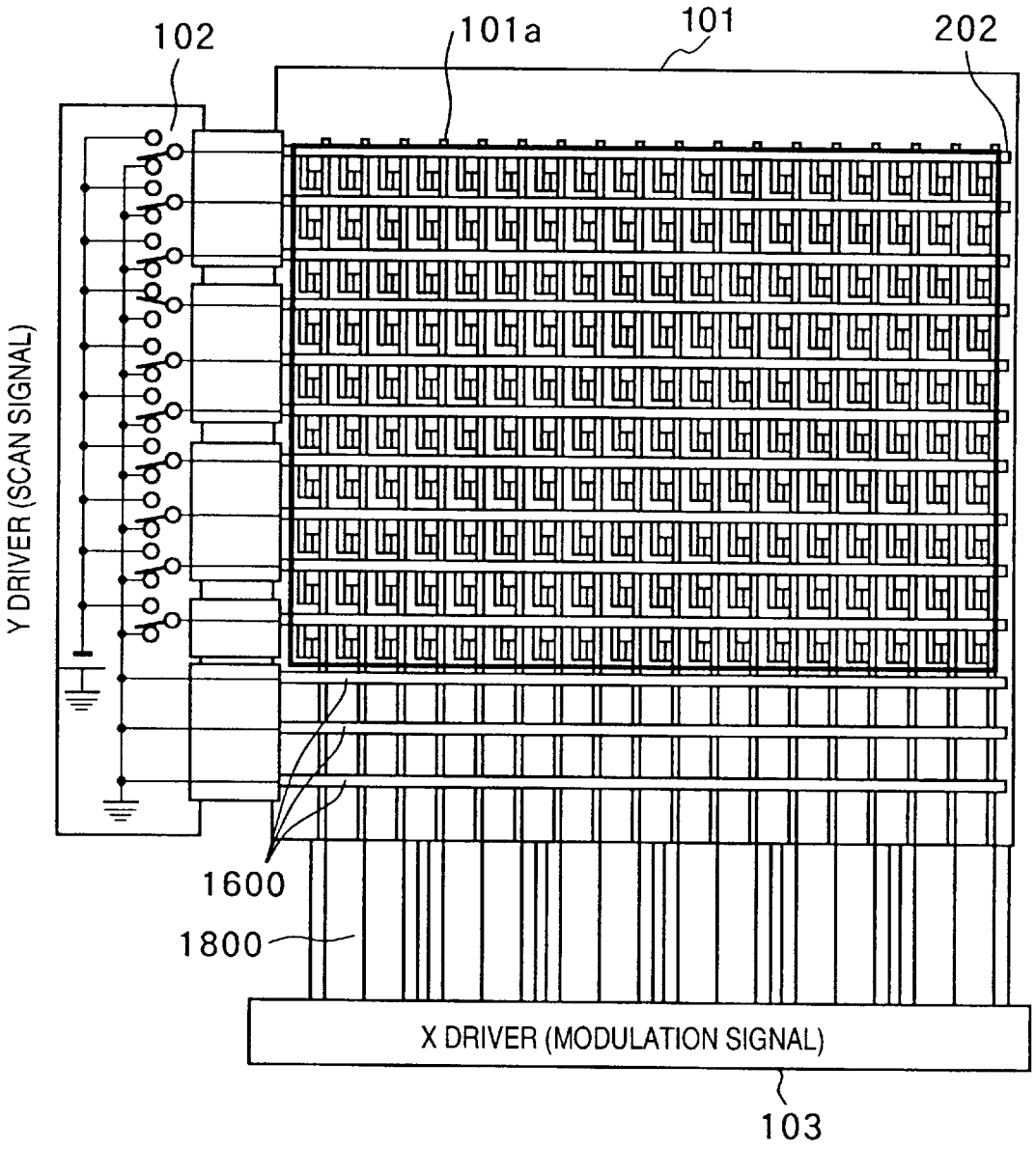
FIG. 20 is an explanatory view showing connections between a display panel and peripheral circuits according to a fifth embodiment of the present invention.

FIG. 20 shows a construction of the fifth embodiment of the present invention. Components common to the above-described drawings are referred to by the same reference numerals, and description thereof will be omitted.

The display panel 101 of the present embodiment is similar to the above-described embodiment in that the characteristic impedance Z0 in the modulation signal direction is expressed approximately by $Z0 \approx \sqrt{L/C}$, assuming that the reactance per device of the image display area 101*a* is L, and a capacitance at an intersection of a column-direction wiring 201 (modulation signal wirings) and a row-direction wiring 202 (scan signal wirings) is C.

According to the fifth embodiment, row-direction wirings 1600 (scan signal wirings) are formed on the connection wirings of the display panel 101, which are connected to the column direction wirings 201, as similar to the image display area 101*a* of the display panel 101 in the aforementioned third embodiment. By virtue of this, the characteristic impedance in the connection wirings has substantially the same value as the characteristic impedance $Z0 \approx \sqrt{L/C}$ of the column-direction wirings (modulation signal direction).

Furthermore, a flexible substrate 1800 is formed with ordinary copper wirings 301 and polyimide 303 lined with copper foil 302 as shown in FIG. 3. By this, the characteristic impedance of the flexible substrate becomes approximately the same as the characteristic impedance $Z0 \approx \sqrt{L/C}$ in the modulation signal direction.

As described above, by matching the characteristic impedance of the flexible substrate 1800 as well as the connection wirings of the display panel 101, which are connected to the column-direction wirings 201 (modulation signal wirings), with the characteristic impedance of the modulation signal direction, one of the ringing factors can be eliminated.

As has been set forth above, according to the present embodiment, in the matrix-type display panel having m×n pixels, ringing which causes unmatched characteristic impedance between the display panel and the connection wirings on the modulation signal side can be reduced, and hence excellent tone representation can be realized.

[Sixth Embodiment]

Figure 21:
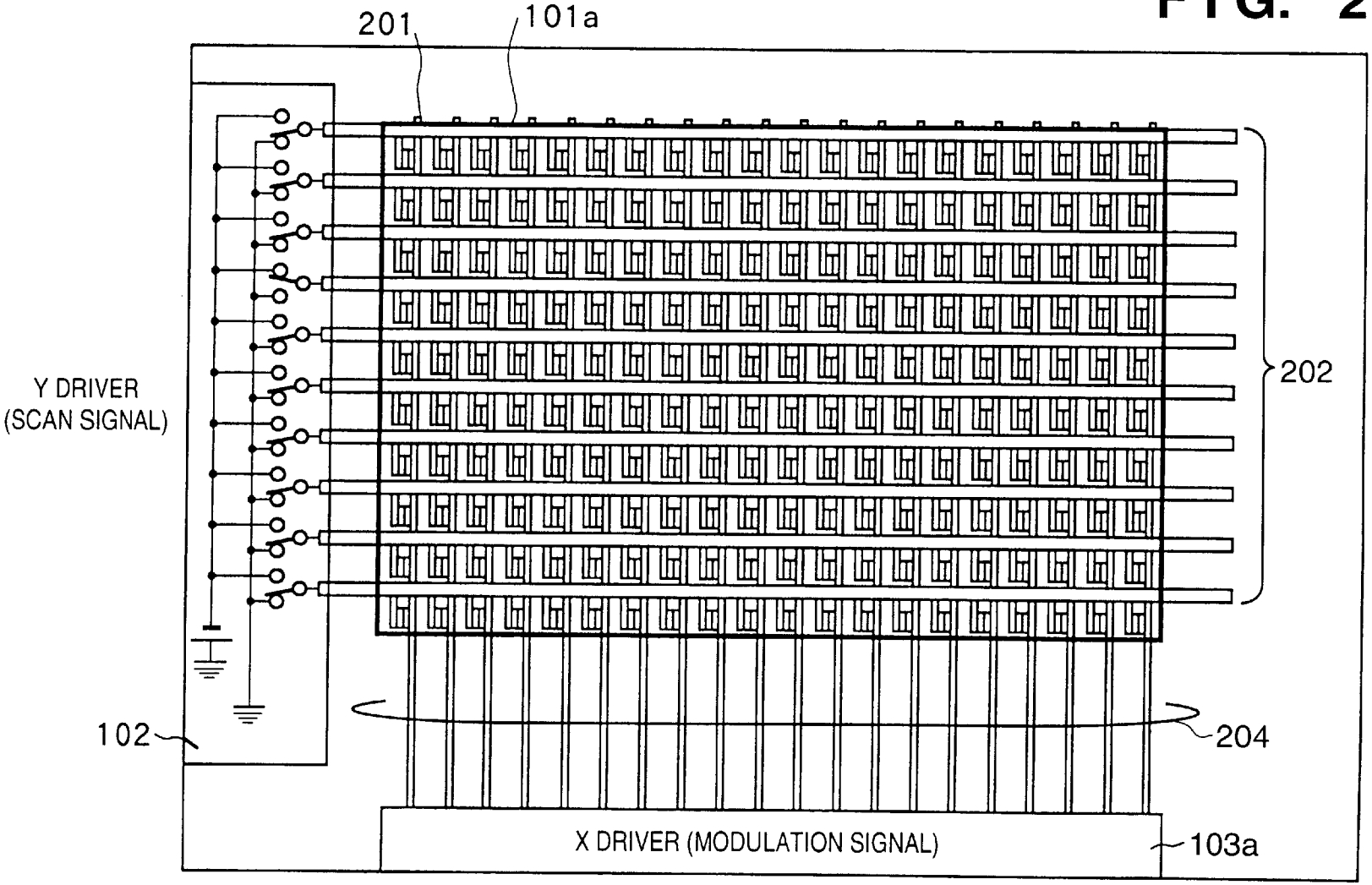
FIG. 21 is an explanatory view showing connections between a display panel and peripheral circuits according to a sixth embodiment of the present invention.
Figure 22:
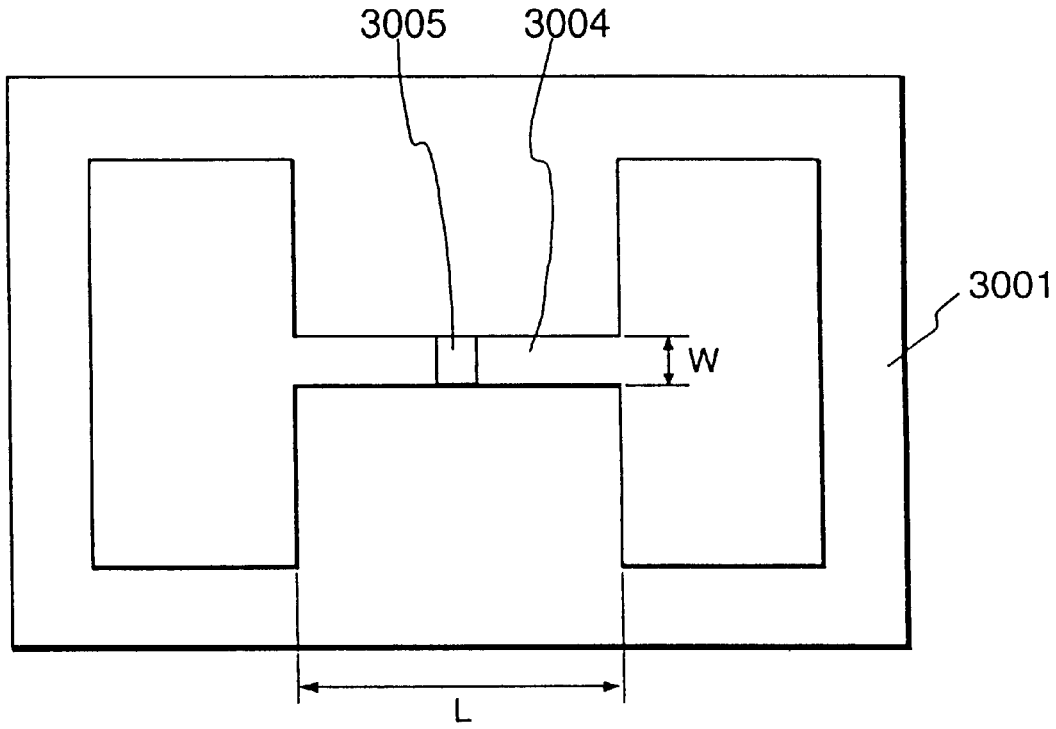
FIG. 22 PRIOR ART
FIG. 22 is a plan view of a conventionally-known surface-conduction-type emitting device.
Figure 23:
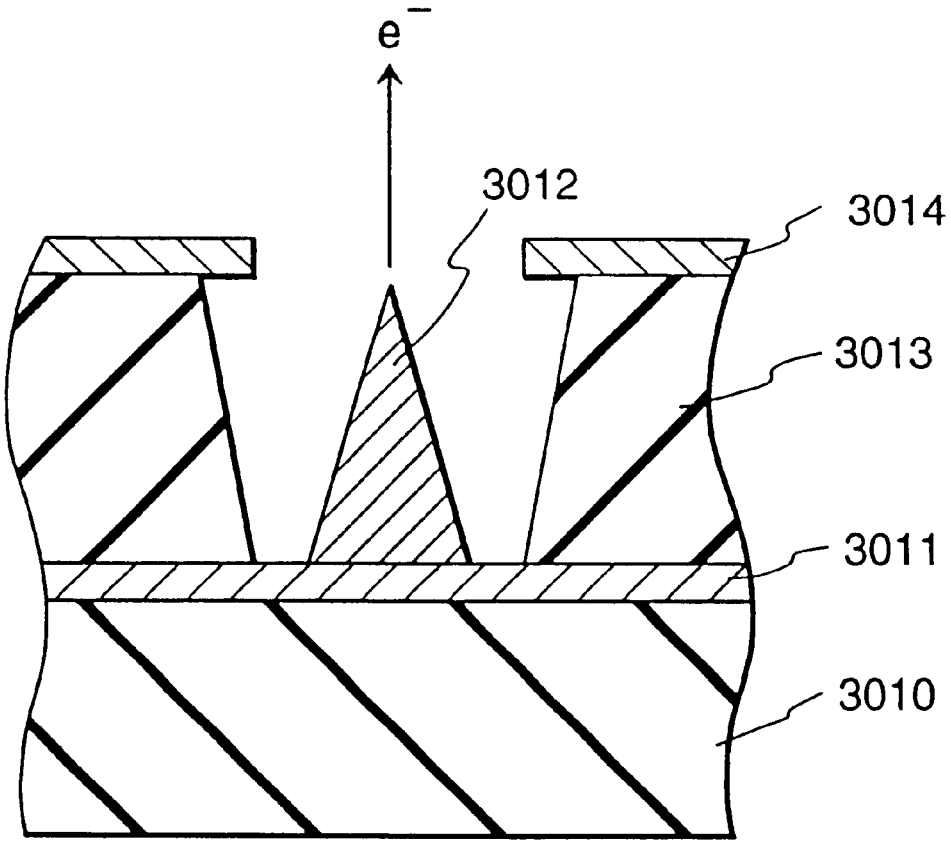
FIG. 23 PRIOR ART
FIG. 23 is a cross-section of a conventionally-known FE type device.
Figure 24:
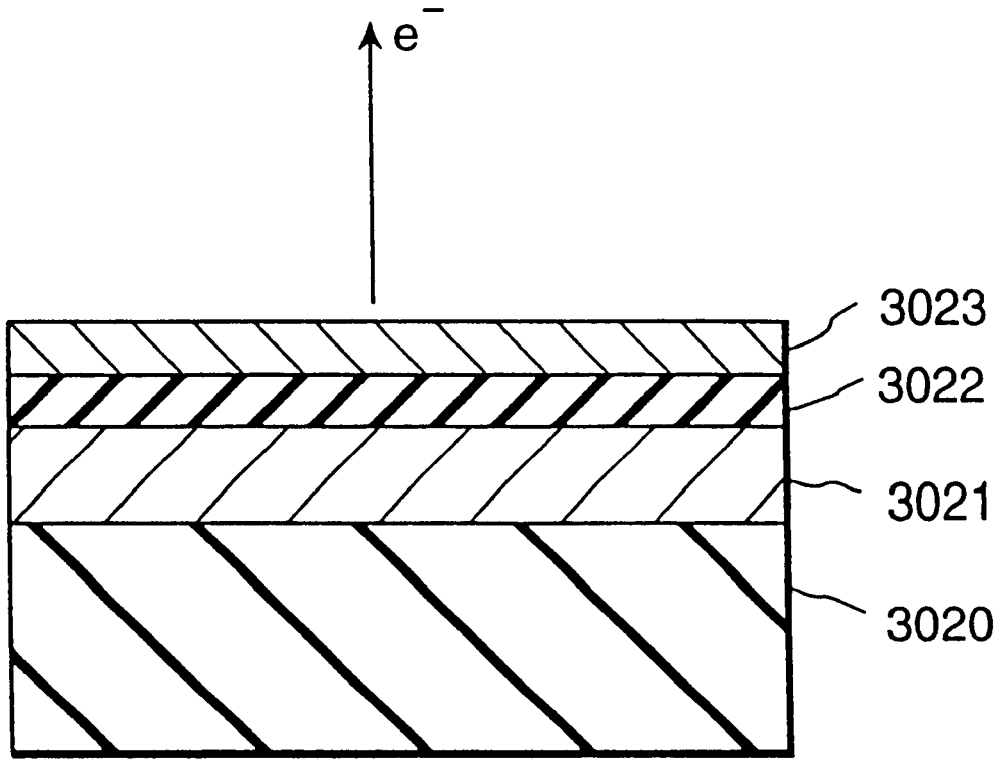
FIG. 24 PRIOR ART
FIG. 24 is a cross-section illustrating a conventionally-known MIM-type device.
Figure 25:
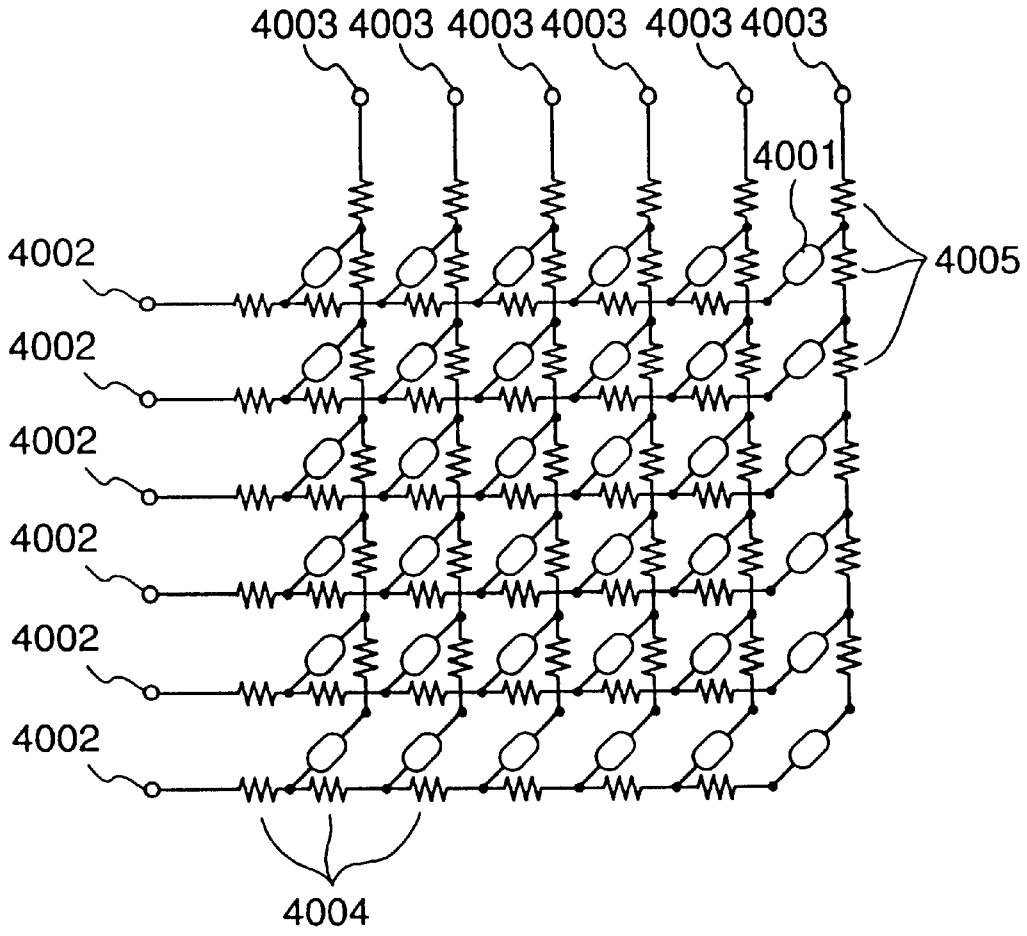
FIG. 25 PRIOR ART
FIG. 25 is an explanatory view of a wiring method of electron emitting devices experimented by the inventor of the present invention, but has raised the problem to be solved.
Figure 26A:
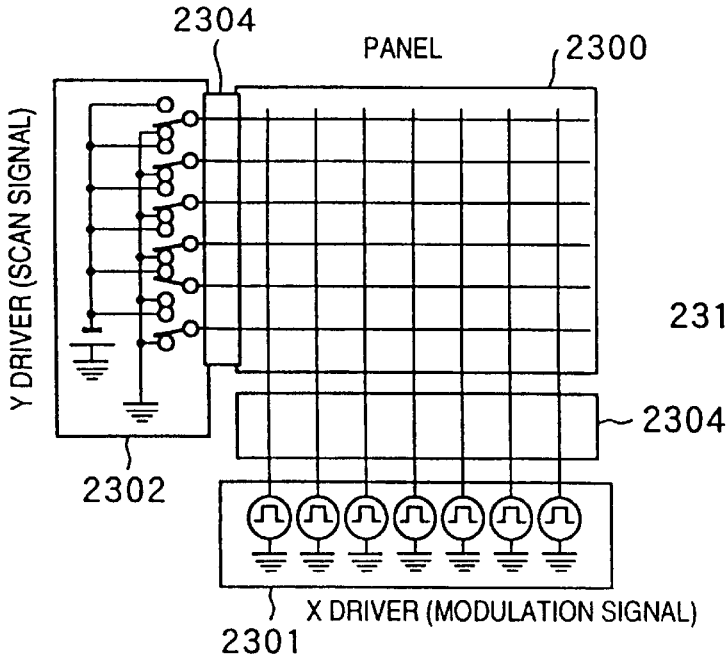
FIG. 26A PRIOR ART
FIGS. 26A and 26B are views explaining a characteristic impedance of a display panel.
Figure 26B:
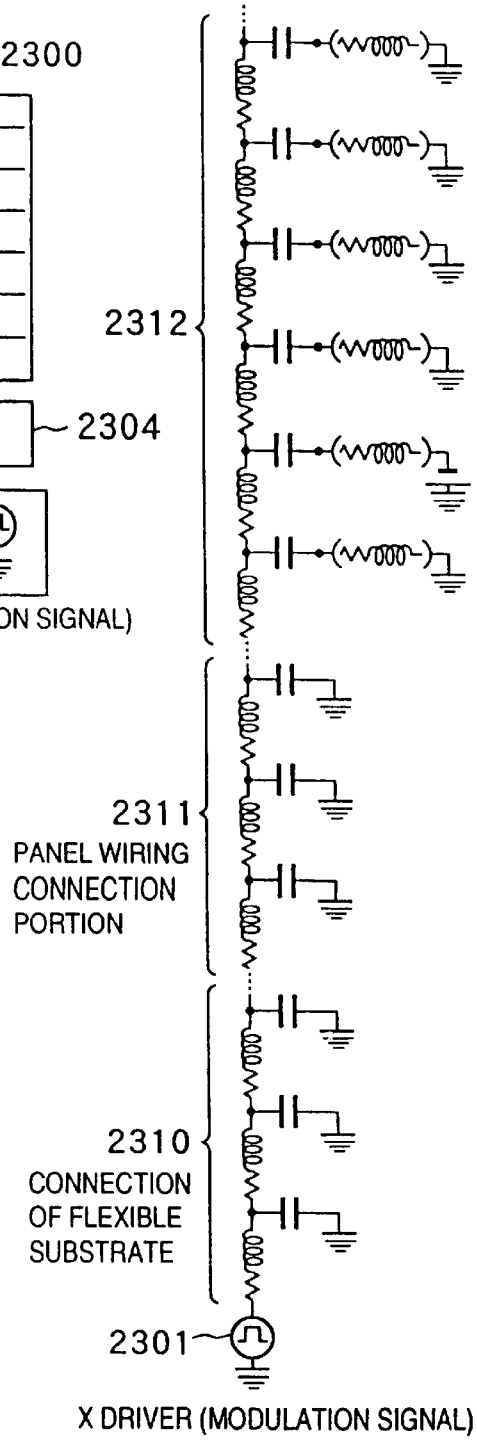
FIG. 26B PRIOR ART

FIG. 21 shows a construction of the sixth embodiment of the present invention.

FIG. 21 shows a part of an image display apparatus 10 where a display panel 101 and X and Y drivers 102 and 103 are connected through connection wirings of the display panel 101. The image display apparatus in FIG. 21 comprises: the display panel 101 in which surface-conduction-type emitting devices having the (device voltage Vf) to (emission current Ie) characteristic shown in FIG. 14 are arranged in m×n matrix wirings; a Y driver 102 for sequentially scanning row-direction wirings 202 (scan signal wiring) to drive the display panel 101; and an X driver 103 which applies the display panel 101, a modulation signal for outputting an image according to an input signal. Note that the positional relationship between the row-direction wirings 202 and column-direction wirings 201 in the display panel 101 is the same as that described in FIG. 2. Thus, in the display panel 101, the characteristic impedance of the column-direction wirings 201 (modulation signal wirings) is determined mainly by a reactance in the image display area 101*a* of the column-direction wirings 201 (modulation signal wirings) as well as a capacitance generated at the intersections of the column-direction wirings 201 (modulation signal wirings) and row-direction wirings 202 (scan signal wirings). Assuming that the reactance per device of the image display area 101*a* is L, and a capacitance at an intersection of a column-direction wiring 201 (modulation signal wirings) and a row-direction wiring 202 (scan signal wirings) is C, the characteristic impedance Z0 in the direction of the column wirings (modulation signals) is expressed approximately by $Z0 \approx \sqrt{L/C}$.

It is so constructed that the impedance in the connection wirings of the display panel 101, which are connected to the column-direction wirings 201 (modulation signal wirings), has substantially the same value as the characteristic impedance $Z0 \approx \sqrt{L/C}$ in the modulation signal direction. Note that a resistance value of the connection wirings 204 can be expressed by the following equation:

$$R = \rho \times L/(w \times d)$$

where a resistivity of the connection wirings 204 is ρ, length is L, line width is w, and height of the wiring is d.

As described above, by matching the impedance of the connection wirings 204 of the display panel 101, which are connected to the column-direction wirings 201 (modulation signal wirings), with the characteristic impedance in the modulation signal direction, one of the ringing factors can be eliminated.

The specific example of the matrix-type display panel 101 having 240×720 pixels has already been described above. From the aforementioned values, the characteristic impedance of the image display area 101*a* of the display panel 101 is roughly calculated to be $Z0 \approx \sqrt{L/C} \approx 60\ \Omega$. Therefore, it is preferable to employ a damping resistance 105 having about 60 Ω resistance for the aforementioned second embodiment.

In a case of matching a characteristic impedance of the connection wirings 204 as described in the sixth embodiment, the connection wirings 204 are formed with Ag wirings having the width of 90 μm, thickness of 0.5 μm, length of 5 mm, and resistivity of $5 \times e^{-8}$ [Ω·m]. In this case, the resistance value is set approximately to 55 Ω.

Although the configuration of each embodiment has been described independently in the above description, the present invention is not limited to this case, but the present invention may be constructed by a combination of the above-described configurations.

In the foregoing second to sixth embodiments, although the description has been given in that the structure for matching characteristic impedance is provided only in the column-direction wirings to which modulation signals are inputted, the present invention is not limited to this case. The structure may be provided in the row-direction wirings, or at least either of the column-direction wirings or row-direction wirings.

The present invention is not limited to the above embodiments and various changes and modifications can be made within the spirit and scope of the present invention. Therefore, to apprise the public of the scope of the present invention, the following claims are made.

What is claimed is:

1. An electron source where a plurality of electron emitting devices are arranged, comprising:

driving means for outputting a driving signal to select and drive an electron emitting device of said electron source; and supply means, having a damping resistance with a resistance value substantially equal to a characteristic impedance of a driving area of said electron source and connected in serial with each signal line that supplies the driving signal, for supplying said electron source with the driving signal outputted by said driving means.

2. The electron source according to claim 1, wherein said supply means includes wiring having a same construction as that of the driving area of said electron source.

3. The electron source according to claim 1, wherein said supply means includes the same conductor and the same insulating layer as the wiring used in the driving area of said electron source.

4. The electron source according to claim 1, wherein said electron source comprises a plurality of electron emitting devices arranged in a matrix with row-direction wiring and column-direction wiring, and said supply means supplies the driving signal to each of the column-direction wiring.

5. The electron source according to claim 1, wherein the impedance of the damping resistance is set in a range from approximately a half to twice the value of the characteristic impedance of the driving area of said electron source.

6. The electron source according to claim 1, wherein said electron emitting device is a surface-conduction-type emitting device.

7. An electron source having a plurality of electron emitting devices arranged in a matrix, comprising:

a scan signal input unit for inputting a scan signal to select and drive an electron emitting device in a row direction of said electron source;

a drive signal input means for inputting a driving signal to select and drive an electron emitting device in a column direction of said electron source; and a signal transmission unit, having a damping with a resistance value substantially equal to a characteristic impedance of a driving area of said electron source and connected in serial with each column-direction wiring that supplies the driving signal, for transmitting corresponding signals between at least either of said scan signal input unit or said drive signal input unit and the driving area.

8. The electron source according to claim 7, wherein said signal transmission unit is constructed similarly to the driving area of said electron source.

9. The electron source according to claim 7, wherein said signal transmission unit is formed with the same conductor and the same insulating layer as a signal line of the driving area of said electron source.

10. The electron source according to claim 7, wherein the impedance of the damping resistance is set in a range from approximately a half to twice the value of the characteristic impedance of the driving area of said electron source.

11. The electron source according to claim 7, wherein said electron emitting device is a surface-conduction-type emitting device.

12. An image forming apparatus comprising:

an electron source in which a plurality of electron emitting devices are arranged in a matrix;

scan driving means for selecting and driving an electron emitting device in a row direction of said electron source in synchronization with an image signal;

driving means for applying a driving signal according to the image signal to the electron emitting device through a column-direction wiring, in synchronization with driving of said scan driving means; and supply means, having a damping resistance with a resistance value substantially equal to a characteristic impedance of a driving area of said electron source and connected in serial with each column-direction wiring that supplies the driving signal, for supplying the column-direction wiring with the driving signal outputted by said driving means.

13. The image forming apparatus according to claim 12, wherein said supply means includes a wiring having a same construction as that of the driving area of said electron source.

14. The image forming apparatus according to claim 12, wherein said supply means includes the same conductor and the same insulating layer as the wiring used in the driving area of said electron source.

15. The image forming apparatus according to claim 12, wherein the impedance of the damping resistance is set in a range from approximately a half to twice the value of the characteristic impedance of the driving area of said electron source.

16. The image forming apparatus according to claim 12, wherein the electron emitting device is a surface-conduction-type emitting device.

17. An electron source comprising:

a plurality of x-direction wiring;

a plurality of y-direction wiring;

an insulating layer disposed at each intersection of the plurality of x-direction and y-direction wiring;

a plurality of electron emitting devices, each of which is connected to one of the plurality of x-direction wiring and one of the plurality of y-direction wiring;

a scan signal applying circuit, connected to the plurality of y-direction wiring, for applying a scan signal to each of the plurality of y-direction wiring; and a modulation signal applying circuit, connected to the plurality of x-direction wiring via a connection member, for applying a modulation signal to each of the plurality of x-direction wiring, wherein the capacitance at each intersection is C, the reactance per one x-direction wiring is L, and the number of electron emitting devices connected to one of the plurality of x-direction wiring is N, and said connection member has substantially the same impedance as a characteristic impedance of $\sqrt{((L/N)/C)}$ in a direction of the x-direction wiring.

18. An electron source according to claim 17, wherein the impedance of said connection member is from a half to twice the characteristic impedance in a direction of the x-direction wiring.

19. An electron source according to claim 17, wherein said connection member includes a flexible cable.

20. An electron source according to claim 17, wherein said electron emitting device is a surface conduction type electron emitting device.

21. An electron source comprising:

a plurality of x-direction wiring;

a plurality of y-direction wiring;

an insulating layer disposed at each intersection of the plurality of x-direction and y-direction wiring;

a plurality of electron emitting devices, each of which is connected to one of the plurality of x-direction wiring and one of the plurality of y-direction wiring;

a scan signal applying circuit, connected to the plurality of y-direction wiring, for applying a scan signal to each of the plurality of y-direction wiring; and a modulation signal applying circuit, connected to the plurality of x-direction wiring, for applying a modulation signal to each of the plurality of x-direction wiring, wherein the capacitance at each intersection is C, the resistance per one x-direction wiring is L, and the number of electron emitting devices connected to one of the plurality of x-direction wiring is N, and said modulation signal applying circuit includes a resistance having substantially the same impedance as a characteristic impedance of $\sqrt{((L/N)/C)}$ in a direction of the X-direction wiring.

22. An electron source according to claim 21, wherein the impedance of the resistance is from a half to twice the characteristic impedance in a direction of the x-direction wiring.

23. An electron source according to claim 21, wherein the resistance is a damping resistance.

24. An electron source according to claim 21, wherein said electron emitting device is a surface conduction type electron emitting device.

25. An image display apparatus comprising:

a first substrate including:

a plurality of x-direction wiring;

a plurality of y-direction wiring;

an insulating layer disposed at each intersection of the plurality of x-direction and y-direction wiring; and a plurality of electron emitting devices, each of which is connected to one of the plurality of x-direction wiring and one of the plurality of y-direction wiring;

a scan signal applying circuit, connected to the plurality of y-direction wiring, for applying a scan signal to each of the plurality of y-direction wiring;

a modulation signal applying circuit, connected to the plurality of x-direction wiring via a connection member, for applying a modulation signal to each of the plurality of x-direction wiring; and a second substrate, arranged opposite to the first substrate, having fluorescent film, wherein the capacitance at each intersection is C, the reactance per one x-direction wiring is L, and the number of electron emitting devices connected to one of the plurality of x-direction wiring is N, and said connection member has substantially the same impedance as a characteristic impedance of $\sqrt{((L/N)/C)}$ in a direction of the x-direction wiring.

26. An apparatus according to claim 25, wherein said electron emitting device is a surface conduction type electron emitting device.

27. An apparatus according to claim 25, wherein the impedance of said connection member is from a half to twice the characteristic impedance in a direction of the x-direction wiring.

28. An apparatus according to claim 27, wherein said connection member includes a flexible cable.

29. An image display apparatus comprising:

a first substrate including:

a plurality of x-direction wiring;

a plurality of y-direction wiring;

an insulating layer disposed at each intersection of the plurality of x-direction and y-direction wiring; and a plurality of electron emitting devices, each of which is connected to one of the plurality of x-direction wiring and one of the plurality of y-direction wiring;

a scan signal applying circuit, connected to the plurality of y-direction wiring, for applying a scan signal to each of the plurality of y-direction wiring;

a modulation signal applying circuit, connected to the plurality of x-direction wiring, for applying a modulation signal to each of the plurality of x-direction wiring; and a second substrate, arranged opposite to the first substrate, having fluorescent film, wherein the capacitance at each intersection is C, the resistance per one x-direction wiring is L, and the number of electron emitting devices connected to one of the plurality of x-direction wiring is N, and said modulation signal applying circuit includes a resistance having substantially the same impedance as a characteristic impedance of $\sqrt{((L/N)/C)}$ in a direction of the x-direction wiring.

30. An apparatus according to claim 29, wherein the impedance of the resistance is from a half to twice the characteristic impedance in a direction of the x-direction wiring.

31. An apparatus according to claim 29, wherein the resistance is damping resistance.

32. An apparatus according to claim 29, wherein said electron emitting device is a surface conduction type electron emitting device.

* * * * *